US009074426B1

(12) United States Patent
West et al.

(10) Patent No.: US 9,074,426 B1
(45) Date of Patent: Jul. 7, 2015

(54) METHOD AND APPARATUS FOR ACCOMMODATING TUBULAR DIAMETER CHANGES

(75) Inventors: William Andrew West, Friendswood, TX (US); Donald Wayne Allen, Richmond, TX (US); Dean Leroy Henning, Richmond, TX (US); Julie Ann Dehne, Cypress, TX (US)

(73) Assignee: VIV Solutions LLC, Richmond, TX (US)

( * ) Notice: Subject to any disclaimer, the term of this patent is extended or adjusted under 35 U.S.C. 154(b) by 142 days.

(21) Appl. No.: 13/278,030

(22) Filed: Oct. 20, 2011

Related U.S. Application Data

(60) Provisional application No. 61/410,348, filed on Nov. 5, 2010, provisional application No. 61/410,351, filed on Nov. 5, 2010, provisional application No. 61/428,989, filed on Dec. 31, 2010, provisional application No. 61/428,995, filed on Dec. 31, 2010, provisional application No. 61/510,069, filed on Jul. 20, 2011, provisional application No. 61/532,556, filed on Sep. 9, 2011.

(51) Int. Cl.
*E21B 17/01* (2006.01)
*B63B 21/66* (2006.01)

(52) U.S. Cl.
CPC ..... *E21B 17/01* (2013.01); *B63B 21/663* (2013.01)

(58) Field of Classification Search
USPC ..... 405/211, 216; 114/243; 52/834, 835; 14/76; 138/99
See application file for complete search history.

(56) References Cited

U.S. PATENT DOCUMENTS

| | | | | |
|---|---|---|---|---|
| 4,398,487 | A * | 8/1983 | Ortloff et al. | 114/243 |
| 4,474,129 | A * | 10/1984 | Watkins et al. | 114/243 |
| 6,010,278 | A * | 1/2000 | Denison et al. | 405/216 |
| 6,048,136 | A * | 4/2000 | Denison et al. | 405/211 |
| 6,347,911 | B1 * | 2/2002 | Blair et al. | 405/216 |
| 6,896,447 | B1 * | 5/2005 | Taquino | 405/216 |
| 7,017,666 | B1 * | 3/2006 | Allen et al. | 166/367 |
| 2002/0146287 | A1 * | 10/2002 | Allen et al. | 405/211 |
| 2003/0000152 | A1 * | 1/2003 | Ryan | 52/3 |
| 2008/0050181 | A1 * | 2/2008 | Masters et al. | 405/211 |
| 2008/0236469 | A1 * | 10/2008 | Masters et al. | 114/243 |
| 2009/0185868 | A1 * | 7/2009 | Masters et al. | 405/216 |
| 2010/0061809 | A1 * | 3/2010 | Allen et al. | 405/216 |
| 2010/0119308 | A1 * | 5/2010 | Somerville et al. | 405/216 |
| 2010/0150662 | A1 * | 6/2010 | Allen et al. | 405/216 |

FOREIGN PATENT DOCUMENTS

WO WO 2008087372 A1 * 7/2008

* cited by examiner

*Primary Examiner* — Benjamin Fiorello
*Assistant Examiner* — Kyle Armstrong
(74) *Attorney, Agent, or Firm* — Blakely Sokoloff Taylor & Zafman LLP

(57) ABSTRACT

An apparatus including a collar member dimensioned to encircle an underlying tubular and having a modifiable diameter to accommodate a change in a diameter of the underlying tubular. The apparatus further including a band dimensioned to encircle the collar member, the band having a modifiable length capable of changing in response to the tubular diameter change. The collar member may have a first section and a second section. A resilient member may be coupled to the collar member between the first section and the second section. A method including modifying a diameter of a collar member positioned around a tubular in response to a diameter change of the tubular, wherein modifying the diameter comprises changing a size of a resilient member coupled to the collar in response to the change in diameter of the tubular.

6 Claims, 24 Drawing Sheets

METHOD AND APPARATUS FOR ACCOMMODATING TUBULAR DIAMETER CHANGES

CROSS-REFERENCE TO RELATED APPLICATIONS

The application claims the benefit of the earlier filing date of

U.S. Provisional Patent Application No. 61/410,348, filed Nov. 5, 2010;

U.S. Provisional Patent Application No. 61/410,351, filed Nov. 5, 2010;

U.S. Provisional Patent Application No. 61/428,989, filed Dec. 31, 2010;

U.S. Provisional Patent Application No. 61/428,995, filed Dec. 31, 2010;

U.S. Provisional Patent Application No. 61/510,069, filed Jul. 20, 2011; and

U.S. Provisional Patent Application No. 61/532,556, filed Sep. 9, 2011, and incorporated herein by reference.

FIELD

Devices for supporting a VIV suppression device along a tubular, more particularly modifiable devices configured to accommodate changes in a diameter of an underlying tubular.

BACKGROUND

A difficult obstacle associated with the exploration and production of oil and gas is management of significant ocean currents. These currents can produce vortex-induced vibration (VIV) and/or large deflections of tubulars associated with drilling and production. VIV can cause substantial fatigue damage to the tubular or cause suspension of drilling due to increased deflections. While helical strakes, if properly designed, can reduce the VIV fatigue damage rate of a tubular in an ocean current, they typically produce an increase in the drag on the tubular and hence an increase in deflection. Thus, helical strakes can be effective for solving the vibration problem at the expense of worsening the drag and deflection problem.

Another solution is to use fairings as the VIV suppression device. A properly designed fairing can reduce both the VIV and the drag. Fairings are usually made to be free to weathervane around the tubular with changes in the ocean current.

Virtually all fairing designs and many helical strake designs for use on vertical or inclined tubulars require a collar. The collar is sufficiently tightened around the tubular so that sliding along the tubular due to gravity, environmental forces, or impact from adjacent appurtenances, is prevented. Collars may be made in a variety of ways, but their primary function is to grip the tubular with sufficient force to keep VIV suppression devices, or other appurtenances, from sliding past the collar.

A difficulty with collar design is keeping sufficient force on the tubular when the tubular outside diameter changes due to hydrostatic pressure. As a tubular is lowered into the ocean, it experiences a compressive force that can reduce the diameter by compressing: the tubular; a coating on the tubular; insulation on the tubular; buoyancy on the tubular; or other material that is attached to the tubular. If the collar is not designed to accommodate changes in the tubular diameter due to hydrostatic pressure, then the collar can lose its ability to sufficiently grip the tubular. Some tubulars, such as drilling risers, may be lowered into the water and later raised from the water, and thus the hydrostatic pressure can change.

Another difficulty with collar design is providing sufficient gripping force along the length of a tubular where the diameter changes in small amounts along the tubular. These variations may be due to: changes imposed by design; variations in the diameter during manufacturing; changes in diameter due to repairs made to the tubular or its coatings, insulation, or buoyancy; changes in material; changes in material stiffness, or anyone of a number of reasons that can cause the diameter to vary.

BRIEF DESCRIPTION OF THE DRAWINGS

The embodiments disclosed herein are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments with reference to the appended drawings. Whenever the shapes, relative positions and other aspects of the parts described in the embodiments are not clearly defined, the scope of the embodiments is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description.

Figure 1:
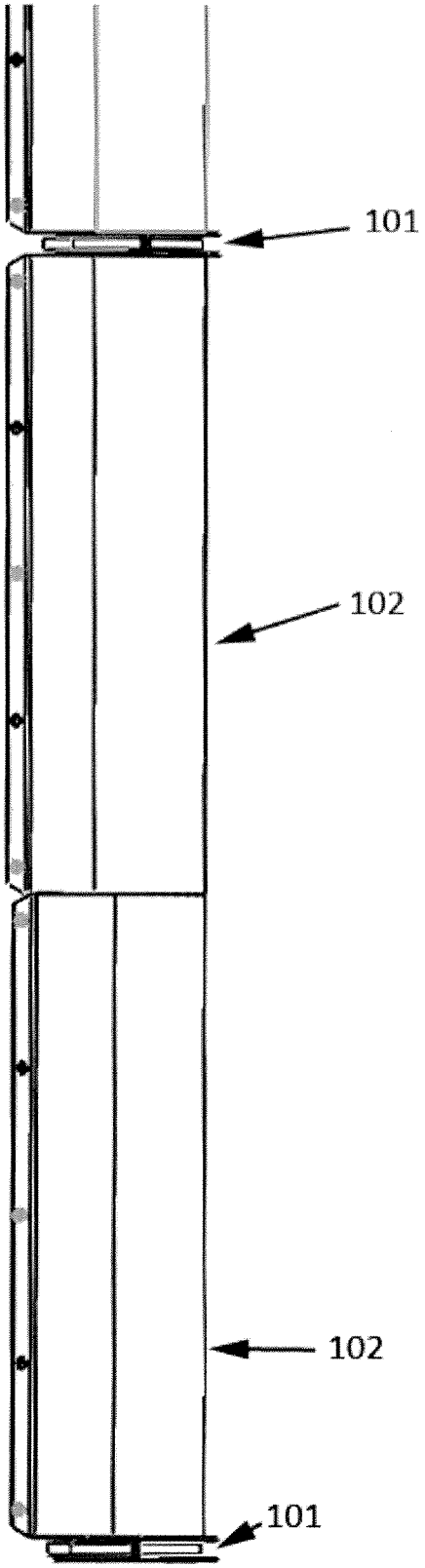
FIG. 1 illustrates a side view of a suppression device held in place around a tubular by collars.

FIG. 1 illustrates a side view of suppression devices 102 held in place by collars 101. In one embodiment, suppression devices 102 are fairings free to weathervane around the tubular while collars 101 are clamped around the underlying the tubular. FIG. 1 illustrates an embodiment in which each of collars 101 support two suppression devices 102. It is contemplated, however, that collars 101 can support any number of suppression devices 102 ranging from 1 to 100, for example where suppression devices 102 are fairings, each of collars 101 can support between 1 and 8 fairings. Collars 101 may also support other suppression devices such as helical strakes, Henning devices, splitter plate type devices, smooth sleeves, perforated structures, or any other device that requires support on a tubular.

Collars 101 may be of any suitable height along the tubular. Typically collars 101 will range from, for example, 1 to 6 inches high. Suppression devices 102 may be of any suitable geometry, as may any other suppression device or structure supported by collars 101. Collars 101 may be made of any suitable material including, but not limited to, thermoplastic, synthetic, metal, composite, fiberglass, wood, or the like.

Figure 2A:
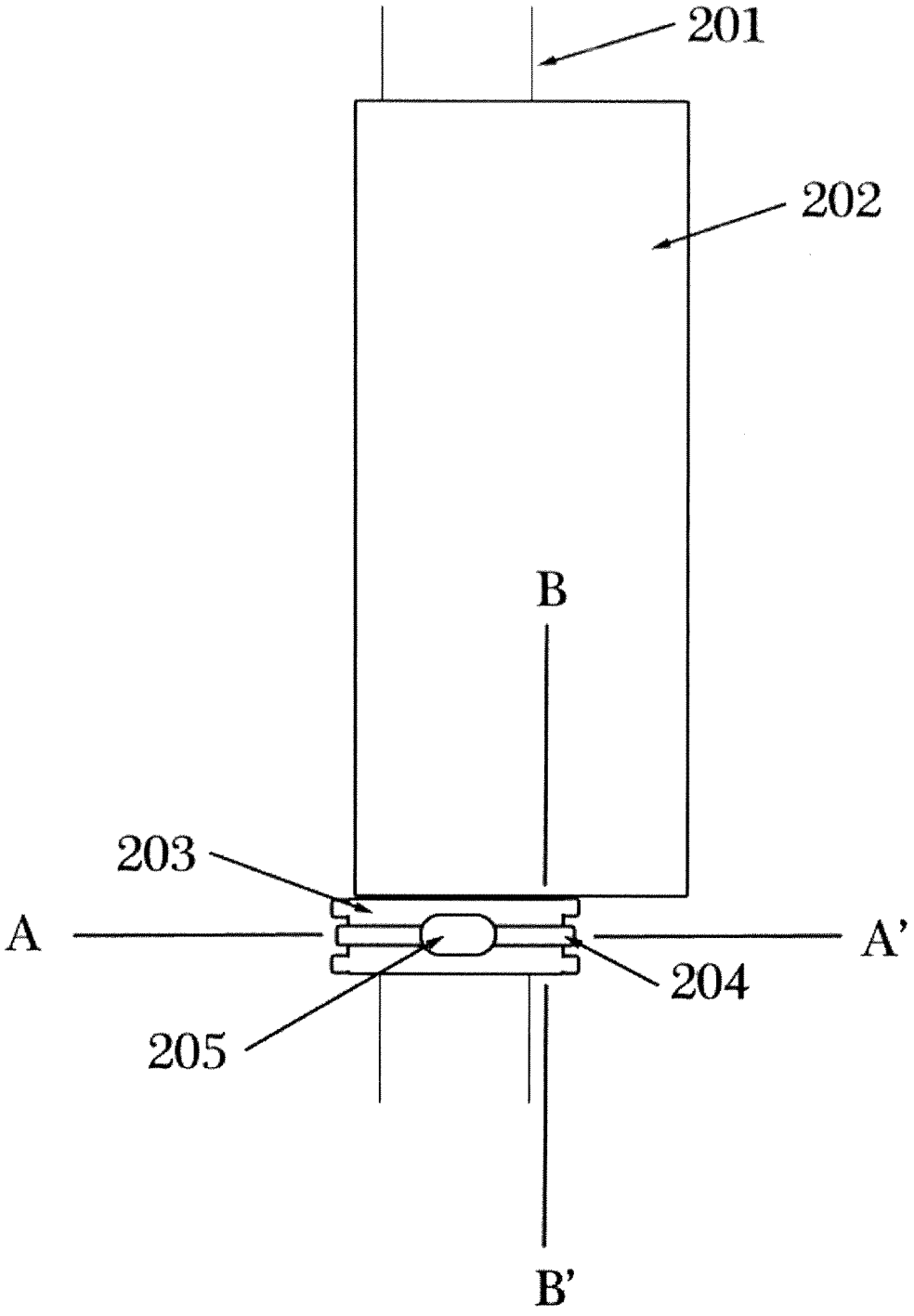
FIG. 2A illustrates a side view of suppression devices attached to an underlying tubular.

FIG. 2A illustrates a side view of tubular 201 with suppression device 202 wrapped around tubular 201. Suppression device 202 is supported by collar 203. Collar 203 keeps suppression device 202 vertically aligned along tubular 201. Collar 203 may also keep a suppression device below (not shown) from sliding upwards past the collar position. Collar 203 may consist of one or more curved sections that, when combined, are dimensioned to encircle tubular 201. Adjacent collar sections can be hinged, bolted, or attached with each other through bolted brackets, plates, or chemical bonding to hold the sections together around tubular 201. Alternatively, the sections may be attached to band 204 as will be discussed in more detail below, or in some cases, directly to tubular 201. In other embodiments, collar 203 may be made of a single section having an opening so that collar 203 may be positioned around tubular 201 by inserting tubular 201 through the opening. In this embodiment, a material of collar 203 may be sufficiently flexible so that a size of the opening can be increased to fit around tubular 201 by bending collar 203. Collar 203 can have an inside diameter substantially similar to the outside diameter of tubular 201 so that it fits snuggly around tubular 201. Collar 203 can have a height that is less than the height of suppression device 202, for example, less than 25 percent of the height of suppression device 202 (e.g. from about 1 to 6 inches high).

It is important that collar 203 be sufficiently tight around tubular 201 to resist forces imposed upon it by suppression device 202 due to gravity and dynamic motions imposed by the environment. In this aspect, once collar 203 is in place around tubular 201, band 204 is placed around collar 203 and tightened to hold collar 203 onto tubular 201. Band 204 may have a modifiable length capable of changing in response to a change in diameter of the underlying tubular 201. In one embodiment, band 204 includes resilient member 205 that can expand or contract depending upon a size of tubular 201. When resilient member 205 expands, a length of band 204 is increased. Alternatively, contraction of resilient member 205 results in a decrease in band 204 length. Representatively, resilient member 205 may be a spring or other similarly resilient and/or modifiable structure or material.

In some embodiments, resilient member 205 is in line with band 204, meaning that an axis formed along a length dimension of resilient member 205 is in line with an axis formed along a length dimension of band 204. Resilient member 205 may also be pre-tensioned or pre-compressed to a desired level of force. If tubular 201 experiences compression or expansion of its diameter, band 204 shrinks or expands through resilient member 205. The presence of resilient member 205 reduces the amount of tension or compression variation in band 204 so that collar 203 can provide sufficient pressure on tubular 201 to resist forces imposed upon it by suppression device 202.

Band 204 may have an inside diameter close to that of the outside diameter of tubular 201 and may compress collar 203 when it is tightened. Band 204 may be smaller in height than the height of collar 203. For example, collar 203 may be 2 to 20 times taller than band 204. More than one band 204 may be used to tighten a single collar 203. Resilient member 205 may, for example, be less than one-sixth of the circumference of collar 203 and band 204, and may be as small as one-twentieth of the circumference of collar 203 and band 204.

Band 204 can be made of any material sufficient to support an adjacent suppression device. Representatively, band 204 may be made of metal such as stainless steel or inconel, or made of a fabric/composite/synthetic material such nylon or polyester rope. Resilient member 205 may be a compression spring or an extension spring and/or can be made of rubber type materials such as urethane, made of a metallic material such as stainless steel, inconel, or copper, or made of any other suitable material or geometry to provide sufficient spring stiffness.

Figure 2B:
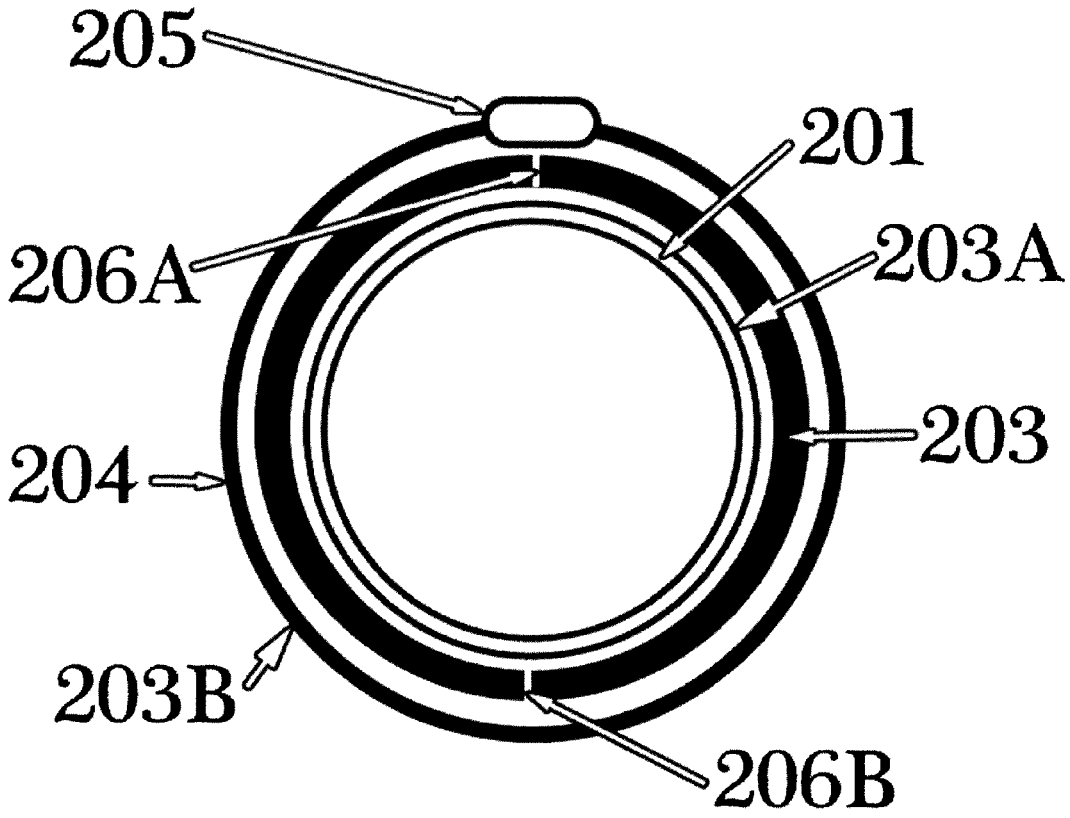
FIG. 2B is a cross-sectional view of the collar and band illustrated in FIG. 2A along line A-A'.

FIG. 2B is a cross-sectional view of the collar and band illustrated in FIG. 2A along line A-A'. FIG. 2B shows tubular 201 with collar 203 positioned around tubular 201. In this embodiment, collar 203 includes first section 203A and second section 203B. In some embodiments, first section 203A and second section 203B may be hinged together at adjacent ends to facilitate opening and closing of collar 203 around tubular 201. First section 203A and second section 203B are positioned around tubular 201 to form collar 203 that encircles tubular 201. Gaps 206A and 206B may be formed between ends of first section 203A and second section 203B. Gaps 206A and 206B allow for a diameter of collar 203 to be modified by band 204 in response to changes in the diameter of tubular 201. Although in this embodiment, collar 203 is formed by two sections 203A, 203B, as previously discussed, collar may be formed by a single section or more than two sections, and in turn, more than two gaps or a single gap may be formed between collar sections. Resilient member 205 is attached to ends of band 204 as illustrated in FIG. 2B and may expand or contract, and in turn increase or decrease a length of band 204, as the underlying tubular 201 experiences changes in diameter. One or more sections of collar 203 may be attached to band 204 using one or more mechanical fasteners such as bolts, screws, rivets, or other suitable fasteners to hold it in place.

Figure 2C:
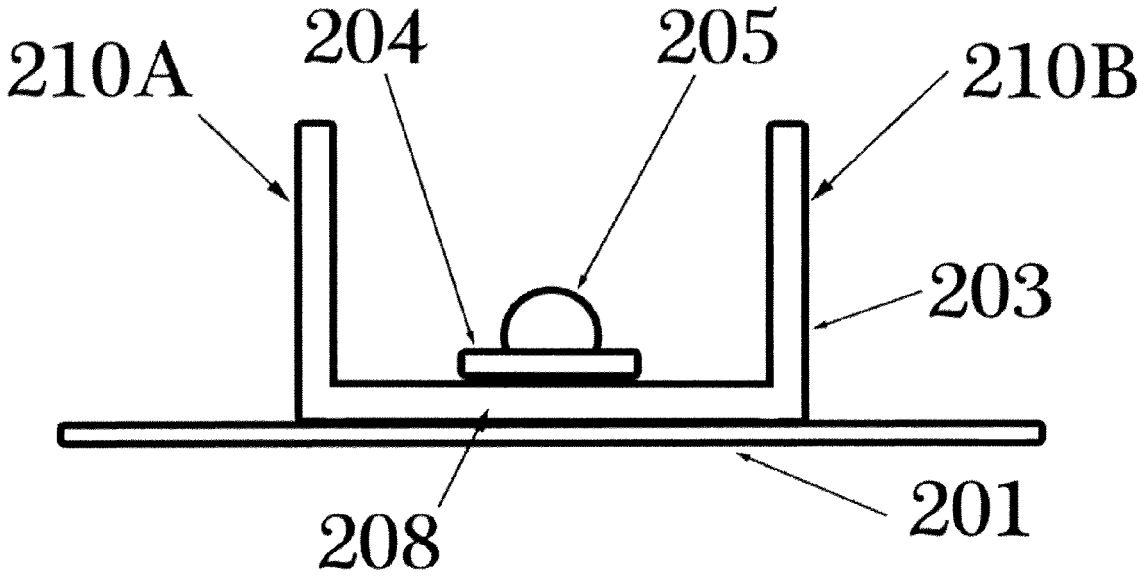
FIG. 2C illustrates a cross-sectional view of the collar and band illustrated in FIG. 2A along line B-B'.

FIG. 2C illustrates a cross-sectional view of the collar and band illustrated in FIG. 2A along line B-B'. From this view, it can be seen that collar 203 has a U-shaped cross section. Band 204, having resilient member 205 attached thereto, is positioned at a base portion 208 of collar 203, and held in place by perpendicularly extending flanges 210A, 210B. Alternatively, collar 203 may have a solid rectangular cross section, an open rectangular cross section with the band 204 interior to the collar cross section, an L-shaped cross section, or any suitable cross section that provides sufficient surfaces for banding and for maintaining the position of the suppression device. Similarly, band 204 may have a rectangular cross section, an L-shaped cross section, a U-shaped cross section, a circular or elliptical cross section, a trapezoidal cross section, or any suitable cross section that provides a sufficient surface for tightening collar 203 while utilizing resilient member 205 in a serial fashion with band 204.

Figure 3:
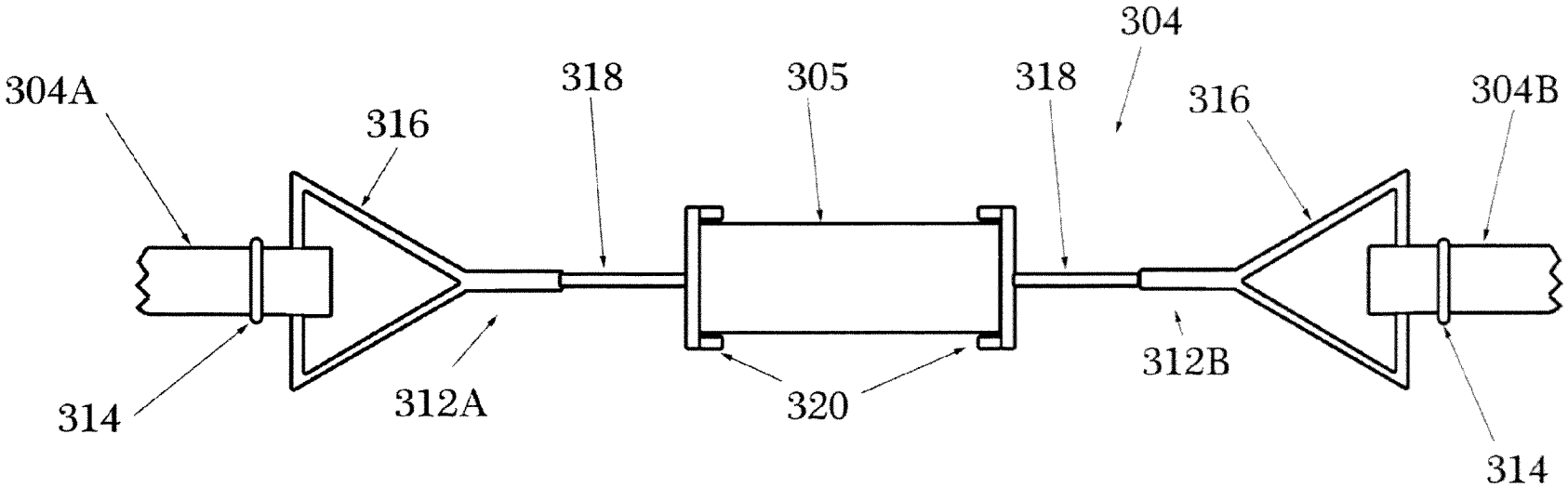
FIG. 3 illustrates a side view of one embodiment of a band having a resilient member.

FIG. 3 illustrates a side view of one embodiment of a band having a resilient member. Band 304 includes first end 304A and second end 304B attached together by resilient member 305. In this aspect, as resilient member 305 expands and contracts, an overall length of band 304 is in turn increased or decreased. Resilient member 305 may be attached to ends 304A, 304B by attachment members 312A, 312B, respectively. Attachment members 312A, 312B may be any type of attachment mechanism suitable for attaching ends 304A, 304B of band 304 to resilient member 305 in a substantially in-line configuration with band 304. An in-line configuration may be desired because in-line springs often provide accommodation for a larger change in buoyancy diameter with less material and expense.

Representatively, in one embodiment, attachment member 312A may include crimp 314, ring 316 and transition piece 318. Crimp 314 may be dimensioned to hold end 304A of band 304 around ring 316. Crimp 314 may be made of any suitable geometry to allow band end 304A to fold over and around the inside of ring 316. Alternatively, band end 304A may be directly welded to ring 316 or directly clamped to ring 316 and thus not require crimp 314. Ring 316 may be attached to housing 320 of resilient member 305 with transition piece 318. Ring 316 may be triangular in shape as shown in FIG. 3, but may also be round, elliptical, square, or any other suitable shape. In addition, more than one ring 316 may be used to form a chain type link. Transition piece 318 may be screwed into ring 316 and housing 320 or may be attached via any other suitable means such as welding, clamping, or bolting. Transition piece 318 may be a rod shaped structure as shown or, have any other shape, for example, a ring shaped structure.

Resilient member 305 is contained within housing 320 by use of flanges on housing 320 or contained by use of a housing that partially or fully encases resilient member 305. Resilient member 305 may be attached to housing 320 by any suitable mechanical means such as bolting or welding. In embodiments where resilient member 305 is a spring, resilient member 305 may have a structural member that runs along the center of spring 305 and attaches to each end of spring 305 to keep the spring centralized along the band axis. Housing 320 may also be eliminated, with transition pieces 318 or rings 316 attached directly to resilient member 305. In addition, band 304 may be directly attached to resilient member 305 with one end of resilient member 305 acting as a ring and inserted through band 304.

Housing 320 may be made of metal, thermoplastic, rubber, fiberglass or other composite structure, and may be shaped in any suitable manner that keeps resilient member 305 in place. Transition piece 318 and ring 316 may be made of any suitable material including metals such as stainless steel and Inconel, thermoplastics, and composites such as fiberglass. As noted above, housing 320, transition piece 318, and ring 316 may each be eliminated and instead, band 304 may be attached directly to resilient member 305.

In some embodiments, attachment members 312A, 312B may include identical structures therefore the foregoing description of attachment member 312A also applies to attachment member 312B.

Still referring to FIG. 3, resilient member 305 accommodates changes in diameter of the tubular by expanding when the tubular expands and contracting when the tubular compresses. In embodiments where resilient member 305 is a spring, the spring may be pre-extended (pre-tensioned) to optimize its accommodation of the tubular diameter changes. Typically, the entire band system is under tension and resilient member 305 (e.g. a spring) is pre-tensioned to allow for shrinkage of the tubular diameter which causes resilient member 305 to retract. By pre-tensioning resilient member 305, a desired amount of tubular shrinkage can be accommodated. Similarly, by allowing resilient member 305 to stretch further than its pre-tension amount, the spring can accommodate increases in the tubular diameter as well.

Figure 4A:
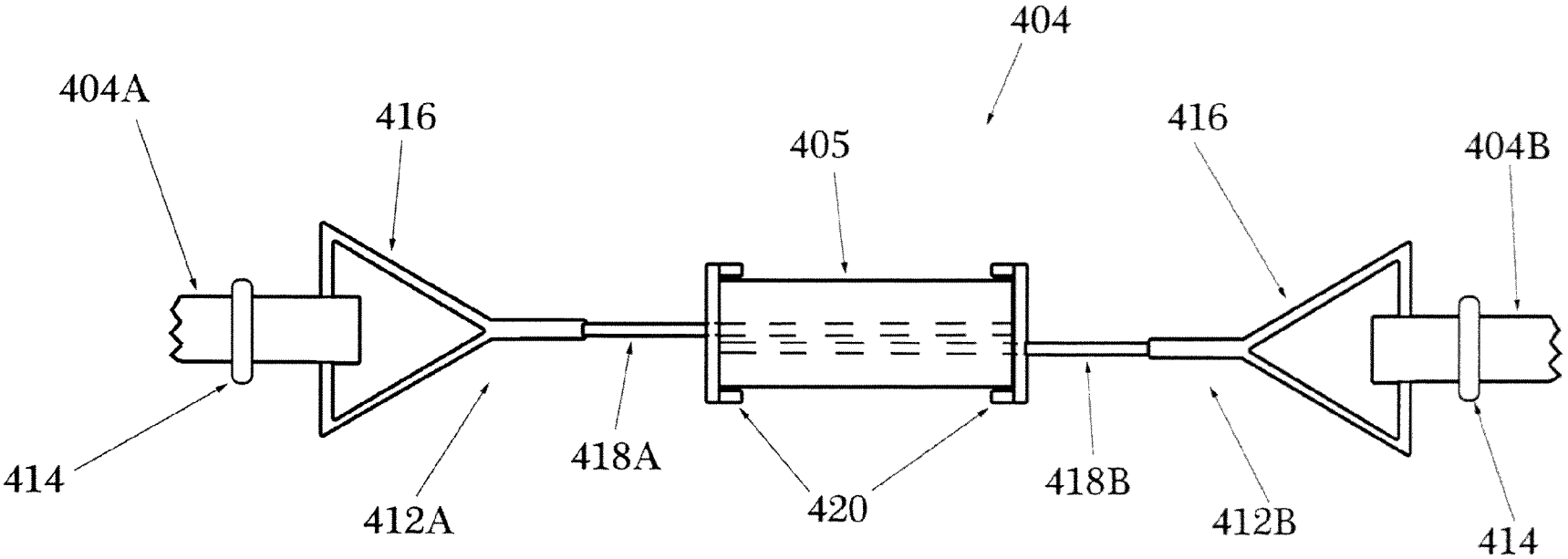
FIG. 4A illustrates a side view of one embodiment of a band having a resilient member.

FIG. 4A illustrates a side view of one embodiment of a band having a resilient member. Band 404, attachment members 412A, 412B and resilient member 405 are similar to those discussed in reference to FIG. 3. In this embodiment, resilient member 405 is illustrated as a compression spring and transition members 418A, 418B extend through housing 420 and attach to opposite ends. Representatively, band ends 404A, 404B attach to respective rings 416, which are connected to housing 420 through transition pieces 418A, 418B. Transition piece 418A runs through housing 420 and resilient member 405 is attached to housing 420 on at a side near band end 404B. Similarly, transition piece 418B runs through housing 420 and resilient member 405 and is attached to housing 420 at a side near band end 404A. This method of running transition pieces 418A, 418B allows for resilient member 405 to be a compression spring. It is desired to have transition pieces 418A, 418B run essentially parallel to each other and to slide smoothly through housing 420.

Resilient member 405 is contained by housing 420; however it is not necessary for housing 420 to exist, since the transition pieces 418A, 418B could each run through resilient member 405 and attach to the ends of resilient member 405 and still allow resilient member 405 to be a compression spring. Ring 416 may also be optional, and in some embodiments, omitted since transition pieces 418A, 418B can be directly attached to band 404 by one of several methods including: having a hook at one end of transition piece 418A, 418B that goes through a hole in band 404; having a hook at one end of transition piece 418A, 418B that goes through the folded end of band 404 which is formed by crimp 414; having a clamp that attaches band 404 to transition pieces 418A, 418B; having transition pieces 418A, 418B welded to band 404; or any other suitable mechanical means.

In embodiments where resilient member 405 is a compression spring, when the compression spring is pre-compressed, the overall band assembly, made of the band 404, the optional crimps 414, the optional rings 416, the transition pieces 418A, 418B, the optional housing 420, and resilient member 405, is lengthened by the compression so that if the tubular diameter is compressed, the band assembly shortens due to less compression of the spring. If the tubular diameter is expanded, resilient member 405 experiences additional compression which lengthens the band assembly as well as resilient member 406. This mechanism allows the band assembly to accommodate the larger diameter with less change in its tension.

Figure 4B:
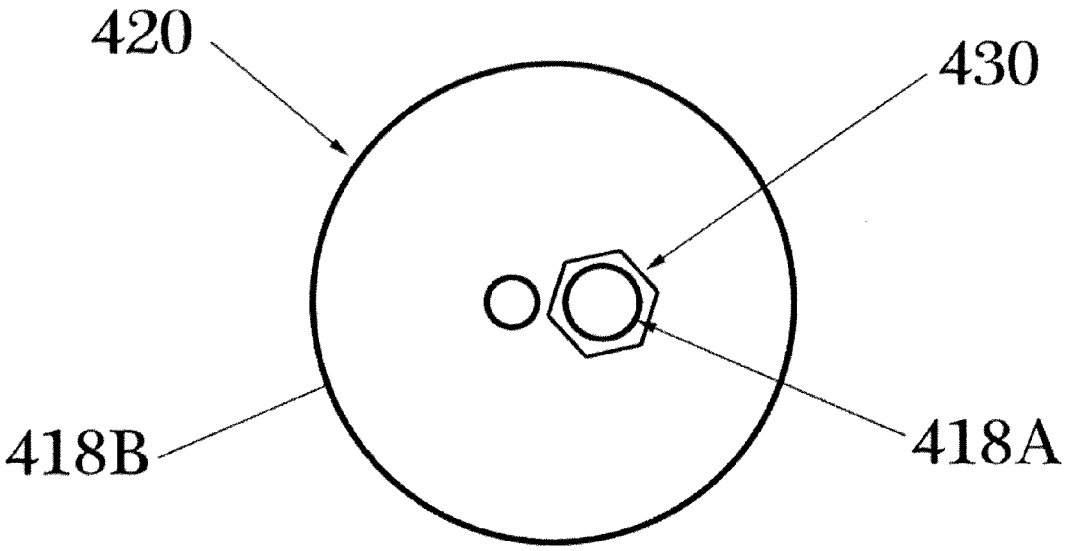
FIG. 4B illustrates a cross-sectional view of the resilient member illustrated in FIG. 4A along line C-C'.

FIG. 4B illustrates a cross-sectional view of the resilient member illustrated in FIG. 4A along line C-C'. In FIG. 4B, housing 420 is shown with transition piece 418B inserted through housing 420 at cross section C-C', and transition piece 418A attached to housing 420 at cross section C-C'. While FIG. 4B shows transition piece 418A with a threaded end acting as a bolt with nut 430 bolting transition piece 418A to housing 420, transition piece 418A may be attached to housing 420 by any other suitable means such as welding, pinning, chemical bonding, or clamping. Similar to transition pieces 418A, 418B and housing 420, nut 430 may be made of any suitable material including metals such as stainless steel or inconel, thermoplastics, or composite materials such as fiberglass.

Although in the previously discussed embodiments, attachment members 312A, 312B and 412A, 412B include transition members 318 and 418A, 418B, respectively, it is contemplated that in some embodiments the transition members may be omitted. In embodiments where transition members 318 and 418A, 418B are omitted, the band ends and/or ring members may be attached directly to the resilient member using any suitable attachment mechanism. For example, a bracket, nut, bolt, pin, flange, thread or any other suitable structure for attaching the ring or band to the resilient member. For example, in an embodiment where the transition member and ring are omitted, the band end may be looped directly around pin members attached to opposing ends of the resilient member and/or housing.

Figure 5:
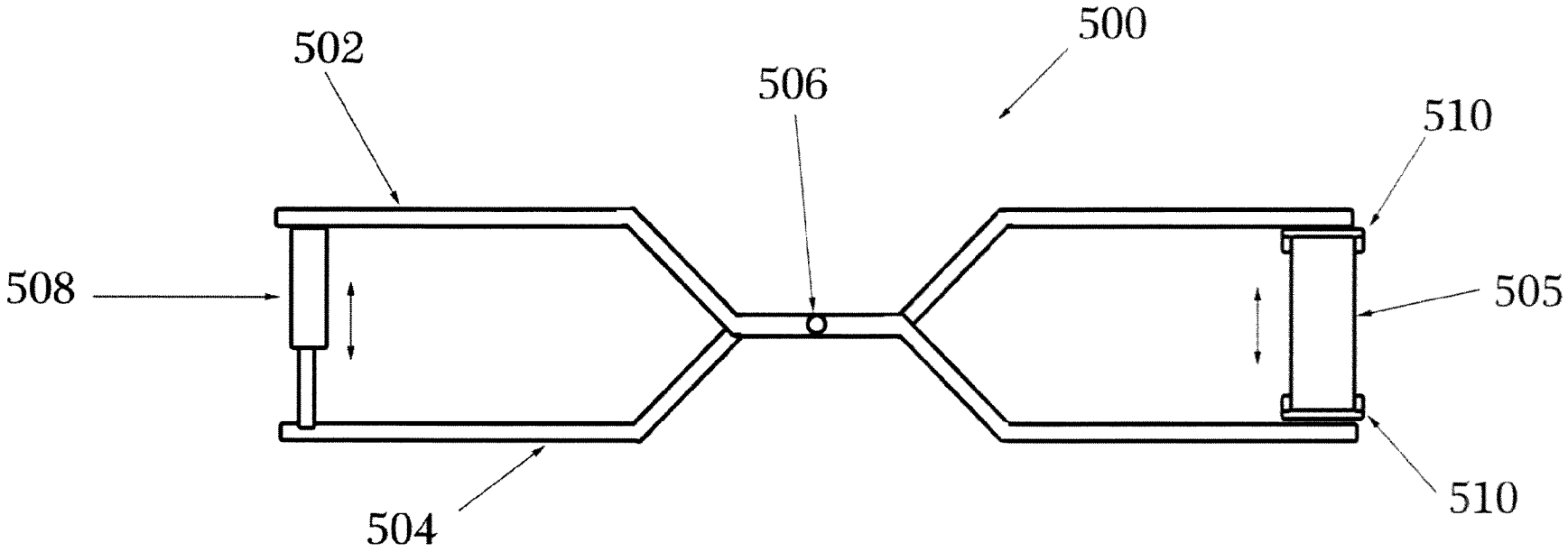
FIG. 5 illustrates a top view of one embodiment of a tensioning device for modifying a tension of a resilient member.

FIG. 5 illustrates a top view of one embodiment of a tensioning device for modifying a tension of a resilient member. Tensioning device 500 may include arm members 502, 504 hinged together at their center in a scissor like configuration. A pressurized extension member 508 may be attached between one end (a first end) of each of arm members 502, 504 and resilient member 505 between another end (a second end) of arm members 502, 504. Extension of pressurized extension member 508 causes the ends of arms 502, 504 attached to pressurized extension member 508 to spread apart, which in turn causes the ends of arms 502, 504 attached to resilient member 505 to spread apart and expand resilient member 505. Resilient member 505 may be contained within a flexible housing 510 which also expands along with resilient member 505. Tensioning device 500 may be used to pre-extended resilient member 505 prior to use to achieve a desired tension level. Pressurized extension member 508 may be extended by increasing a pressure therein and contracted by decreasing a pressure therein. In some embodiments, arms 502, 504 may be dimensioned so as to allow attachment of housing 510 or resilient member 505 to a band assembly such as those depicted above. For example, the ends of arms 502, 504 and housing 510 may have complimentary attachment members (e.g. hooks and loop, brackets, etc.) so that housing 510 may be easily attached to arms 502, 504.

It is contemplated that arms 502, 504 may be sufficiently long to impose the desired length or tension on resilient member 505. Pressurized extension member 508 may be any type of pressurized device that is not overly bulky, heavy, or expensive. For example, pressurized extension member 508 may be a hydraulic or pneumatic cylinder that is pressurized with any suitable fluid. Arms 502, 504 may have near identical separation between them at each end as shown in FIG. 5, or may have separation between them at each end that is different. Similarly, the distance between each end of arms 502, 504 and hinge 506 may be identical or may be different. These distances will be chosen based upon the tong design, the cylinder design, and the amount of spring extension required. Arms 502, 504 may be made of any suitable material including: metals such as steel, aluminum, copper, and inconel; thermoplastics; and composites such as fiberglass.

Although a tensioning device having a scissor like configuration is illustrated, it is further contemplated that arms 502, 504 of device 500 may be attached in such a manner to allow them to move in opposite directions at each end. In this aspect, extension of pressurized extension member 508 produces compression of resilient member 505 which is contained in housing 510.

Figure 6:
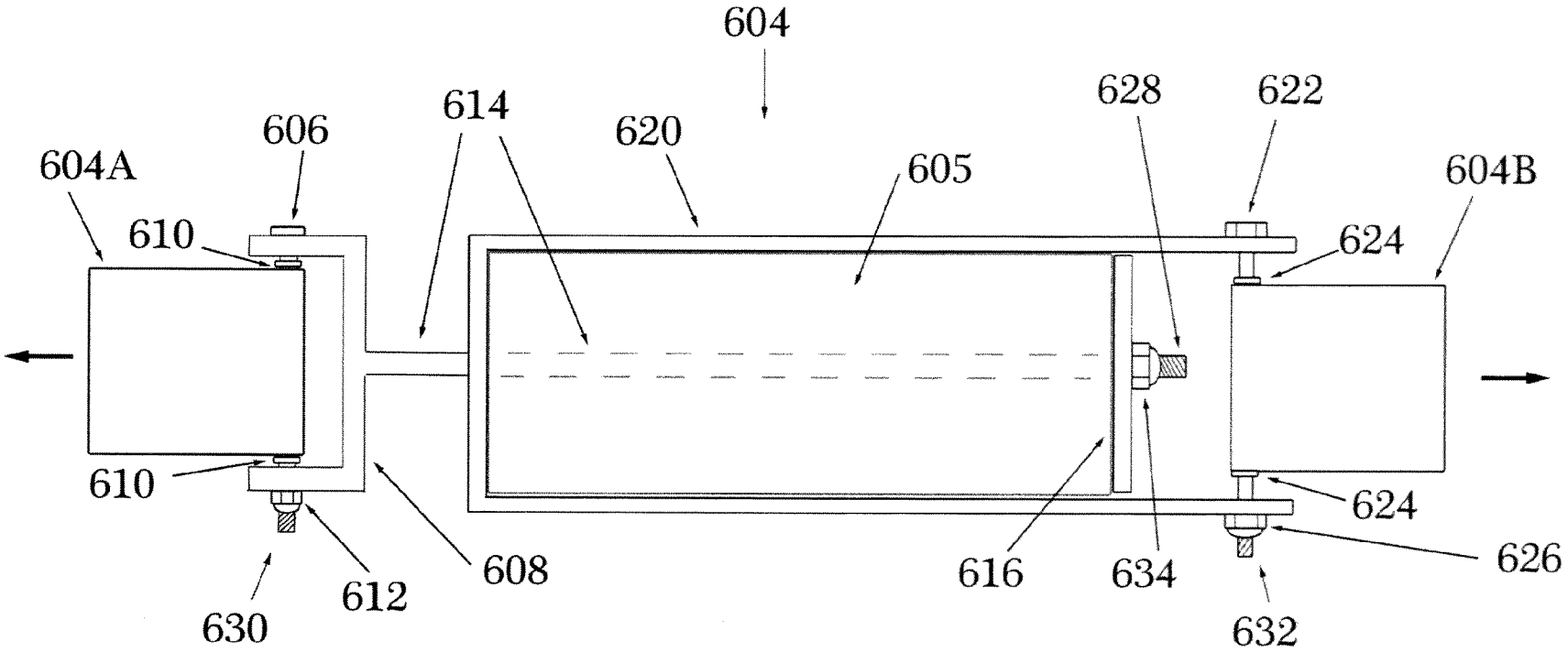
FIG. 6 illustrates a side view of another embodiment of a band attached to a resilient member.

FIG. 6 illustrates a side view of another embodiment of a band attached to a resilient member. In this embodiment, ends 604A, 604B of band 604 are shown attached to resilient member 605. Resilient member 605 is positioned within housing 620. Ends 604A, 604B are attached to housing 620 using attachment members 630, 632, respectively. Attachment members 630, 632 may be the same or different.

In one embodiment, attachment members 630, 632 include a fastener system such as a clevis fastener. Representatively, attachment member 630 includes clevis pin 606 and clevis 608. End 604A is wrapped around pin 606 and held in place with clamps 610. Pin 606 may be held in place using nut 612 and is attached to clevis 608. A rod 614 is attached to clevis 608 and runs through resilient member 605 and plate 616. Rod 614 is attached to plate 616 by nut 612. In some embodiments, resilient member 605 is not attached to housing 620 and is housed in housing 620 only by interference. Housing 620 also has a clevis attached to an end adjacent band end 604B. Band end 604B wraps around clevis pin 622. Band end 604B is held in place on clevis pin 622 by clamps 624 and clevis pin 622 is held onto housing 620 by nut 626.

Tension placed on band 604 causes resilient member 605 to compress by relative movement between plate 616 and housing 620. When band end 604A is pulled in tension, force is transmitted through the clevis 608 and bolt 628 to plate 616 putting force in a direction toward end 604A on the opposite end of resilient member 605 (end adjacent band end 604B). When band end 604B is pulled in tension, force is transmitted through clevis pin 622 and housing 620, thereby putting a force directed towards end 604B on the opposite end of resilient member 605 (end adjacent band end 604A).

It is contemplated that clevis pins 606 and 622 may be replaced by a bolt, a welded structural member (which eliminates the need for nut 612 or nut 626), or any other suitable structure capable of supporting the tension in band 604. Clamps 610, 624 may consist of washers, hose clamps, welded flanges, O-rings, or any structure capable of restraining band 604 from sliding along clevis pin 606. Nuts 612, 634, and 626 may be single nuts, double nuts, nylock nuts or any other suitable nut. Rod 628 may be attached to clevis 608 by any suitable means including welding, bolting, etc. Rod 628 may be a machined piece, a piece of pipe or tubing, a chain, a bolt, or other suitable structure that can withstand the same tension as the band and be attached to plate 616 at one end and clevis pin 606 at the other end. Rod 628 may be fully or partially threaded or may not have threads at all and be welded or fastened to plate 616 by using brackets, bolts, screws, chemical bonding, or any other suitable means. Housing 620 may have an opening through which rod 628 is free to slide so that resilient member 805 may be compressed. The face of housing 620 through which rod 628 extends may consist of a plate with a hole in it, a washer, two or more bolts, or any other suitable structure through which rod 628 can slide and be controlled. The sides of housing 620 may be made of tubing, plate, rods, cable, bolts, or any suitable structure that is able to accommodate a plate on the left end of resilient member 605 and accommodate mechanisms for attaching band end 604B. Clevis 608 and the opposite side of housing 620 may be replaced by other suitable mechanical mechanisms such as brackets, plates, rods, cable, or any combination thereof. These mechanisms may be welded, fastened, or bonded by any suitable means.

Housing 620, clevis 612, clevis pins 606 and 622, nuts 612, 634, and 626, plate 616, rod 628, and clamps 610 may be made from any suitable material including metals such as: stainless steel, inconel, aluminum, and copper; thermoplastics; or composites such as fiberglass. Band 604 may be made from any suitable material including metals such as stainless steel, inconel, aluminum and copper; thermoplastics; or composites such as fiberglass; synthetic materials such as rubber or fabric. Resilient member 605 may be made of any suitable material including: metals such as inconel, stainless steel, aluminum or copper; synthetics such as urethane or rubber; or composites such as fiberglass. The materials for all components may all be the same or they may each be different.

Band 604 may vary in size. For example, band 604 may be ¼inch to 8 inches wide and $1/32^{nd}$ to ¼inch thick. In some embodiments, resilient member 605 may be a spring having a cylindrical cross section but may have other cross sections as desired. Resilient member 605 may be 1 to 12 inches long and, if cylindrical in cross section, will have a diameter ranging from ½ inch to 6 inches.

Figure 7:
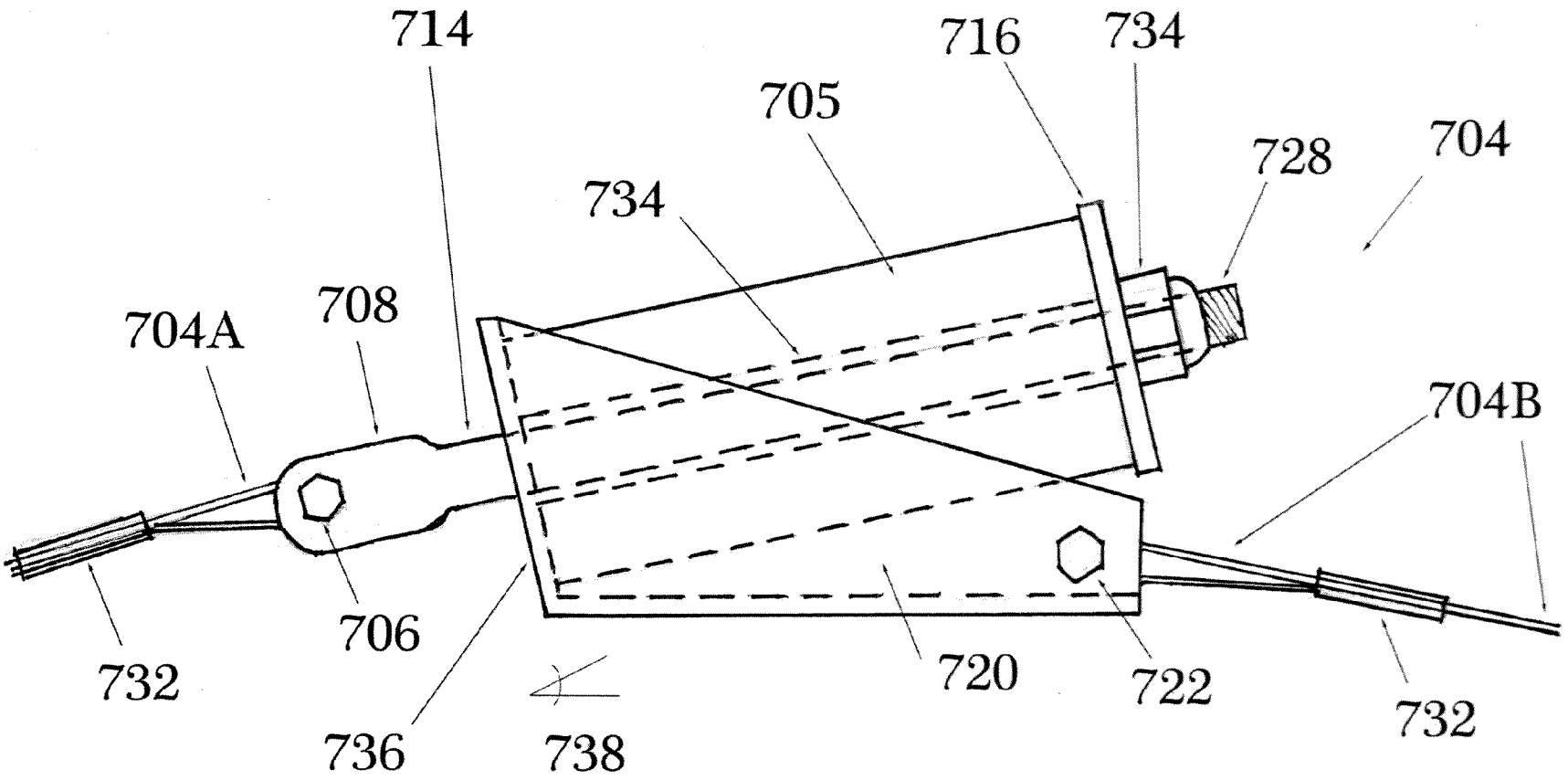
FIG. 7 illustrates a top view of an embodiment of a band attached to a resilient member.

FIG. 7 illustrates a top view of a band and resilient member similar to that of FIG. 6, with the exception that housing 720 does not have a clevis and is substantially the same length as resilient member 705 (whereas housing 620 is significantly longer than resilient member 605 in FIG. 6). In FIG. 7, clamps 732 are shown on each of ends 704A, 704B of band 704. Band end 704A is wrapped around clevis pin 706 while band end 704B is wrapped around clevis pin 722. Bolt 728 is attached to clevis 708 at one end and is run through housing 720, resilient member 705, and plate 716 and is attached to plate 716 with nut 734. Resilient member 705 has an annulus 734 to accommodate rod 728 Annulus 734 may, or may not, contain a tube or other structure to reduce friction on rod 728 with rod 728 residing inside that tube or structure.

Tension on band 704 causes clevis 708 to move towards band end 704A thereby putting pressure on resilient member 705 through plate 716 as plate 716 is engaged by rod 728. Tension in band 704 also causes a force in the direction of band end 704B on housing 720 through clevis pin 722. Thus, tension in band 704 causes compression of resilient member 705. FIG. 7 shows resilient member 705 at an angle 738 relative to housing 720. Optional angle 738 may be any angle sufficient to reduce friction on resilient member 705 that it could experience from housing 720 and to maximize the length of band 704 that is against the collar. Representatively, angle 738 may be between, for example, 2 degrees and 15 degrees. While for some applications angle 738 will not be needed, it is also possible to attach band 704 to resilient member 705 at a location other than the center axis of resilient member 705 such as at the bottom of resilient member 705 in FIG. 7, so that the angle between resilient member 705 and housing 720 may be minimized, possibly even to no angle at all.

Still referring to FIG. 7, the side of housing 720 that engages rod 728, namely face 736, may be welded to the rest of housing 720 to form any desired angle between face 736 and the rest of housing 720. Housing 720 may be made from square piping or tubing, round piping or tubing, other geometries of piping or tubing, plate, rods, bolts, cable, or any suitable structures that can accommodate clevis pin 722 at one end and face 736 at the other end. Clamps 732 hold band end 704A around clevis pins 706 and 722, and may be any suitable clamp. Clamps 732 may be replaced by welds, bolts, crimps, brackets, chemical bonding, or any other suitable attachment mechanism for holding band 704 around clevis pins 706 and 722. Still further, one or both of clevis pins 706, 722 may be replaced with, for example, a T-bolt and band ends 704A, 704B attached to themselves by, for example, welding, bolting, crimping, chemical bonding, or fastening. In this aspect, a slot may be cut in band 704 to accommodate a head of the T-bolt.

Figure 8:
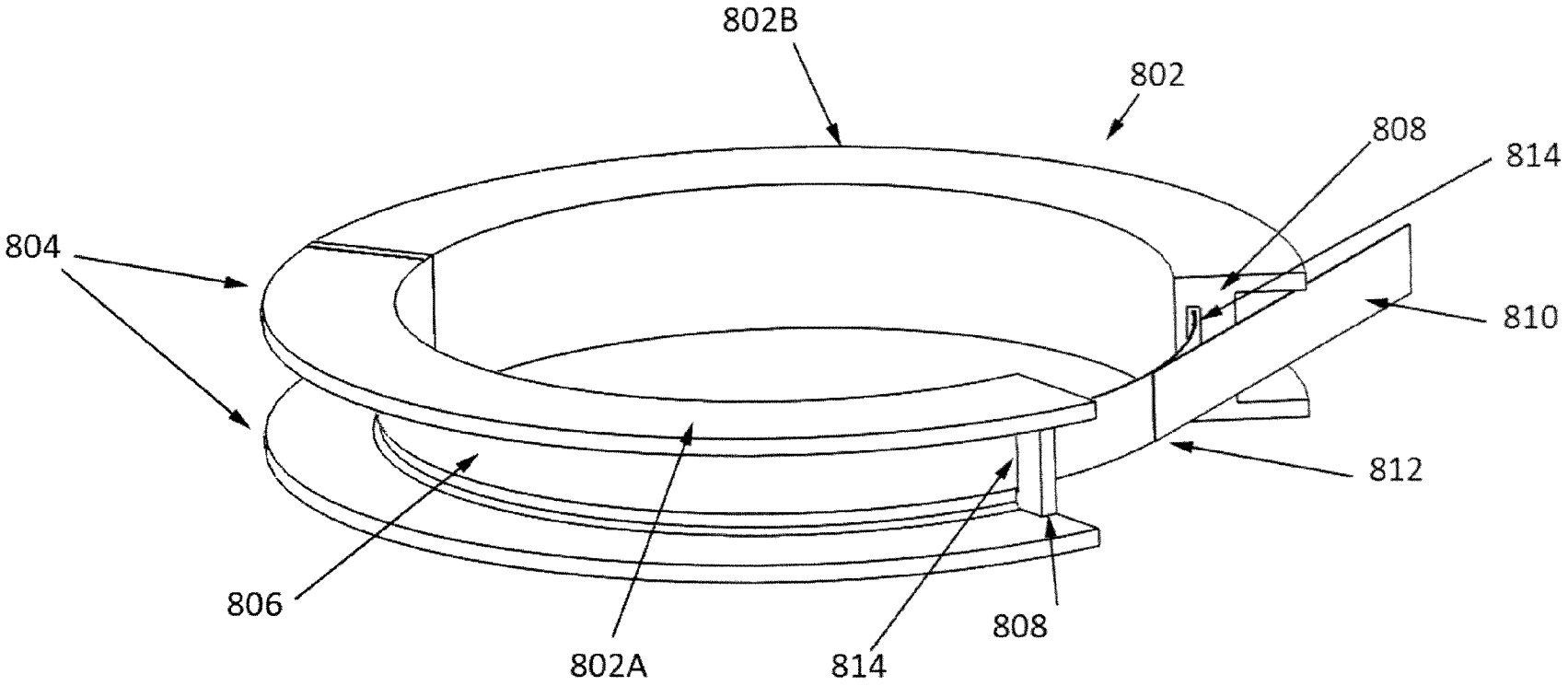
FIG. 8 illustrates a perspective view of another embodiment of a collar having a band for accommodating changes in tubular diameter.

FIG. 8 illustrates a perspective view of another embodiment of a collar having a band for accommodating changes in tubular diameter. In this embodiment, collar 802 includes flanges 804 that extend from a base portion 806 to form a substantially "U" shaped collar. Collar 802 may include first section 802A and second section 802B. First section 802A and second section 802B may be separated to facilitate placement of collar 802 around an underlying tubular. Alignment members 808 may be formed at one or more ends of first section 802A and 802B to facilitate alignment of band 810 around collar 802. Alignment members 808 extend outwardly and substantially perpendicular to base portion 806, between flanges 804. In some embodiments, adjacent alignment members 808 may be joined by a hinge or other structure to attached adjacent collar sections together. Slot 814 is formed through a portion of alignment member 808 adjacent base portion 806 of collar 802. Band 810 is wrapped around base portion 806 of collar 802 and through slot 814. Inserting band 810 through slot 814 holds band 810 against base portion 806 and between flanges 804.

In some embodiments, alignment members 808 may have a height that is substantially equivalent to that of flanges 804 or less than flanges 804 to allow additional room for any installation tools. For example, alignment members 808 may range in height from about the thickness of band 810 to the height of flanges 804 of collar. Slot 814 may be of any cross section suitable to at least partially encircle band 810. In this aspect, slot 814 need not be completely enclosed. Alignment members 808 may be made as part of collar 802 or may be made separately and attached with any suitable fastening mechanism.

Alignment members 808 provide several important functions, including stiffening of collar 802, guidance for band 810, and a structure to preinstall band 810 so as to speed up installation. During operation, band 810 runs completely around the tubular and tightened to keep collar 802 tight against the tubular. Once band 810 is sufficiently tight around collar 802, ends of band 810 are held together by a buckle, clamp, seal, or other fastening system sufficient to secure ends of band 810 together at the desired tension.

Collars 802, flanges 804, and alignment members 808 may be made of any suitable material including, but not limited to, thermoplastic, synthetic, metal, composite, fiberglass, wood, etc. Band 810 may be made of any suitable material but most commonly is made of a metal, such as Inconel or other alloy, or it is made of a synthetic or composite material such as a SmartBand®. In some embodiments, band 810 further includes a resilient property to allow a length of band 810 to change to accommodate changes in a diameter of an underlying tubular. Alternatively, collar 802 itself may have a resilient property that allows a diameter of collar 802 to change in response to a change in diameter of the underlying tubular.

Figure 9A:
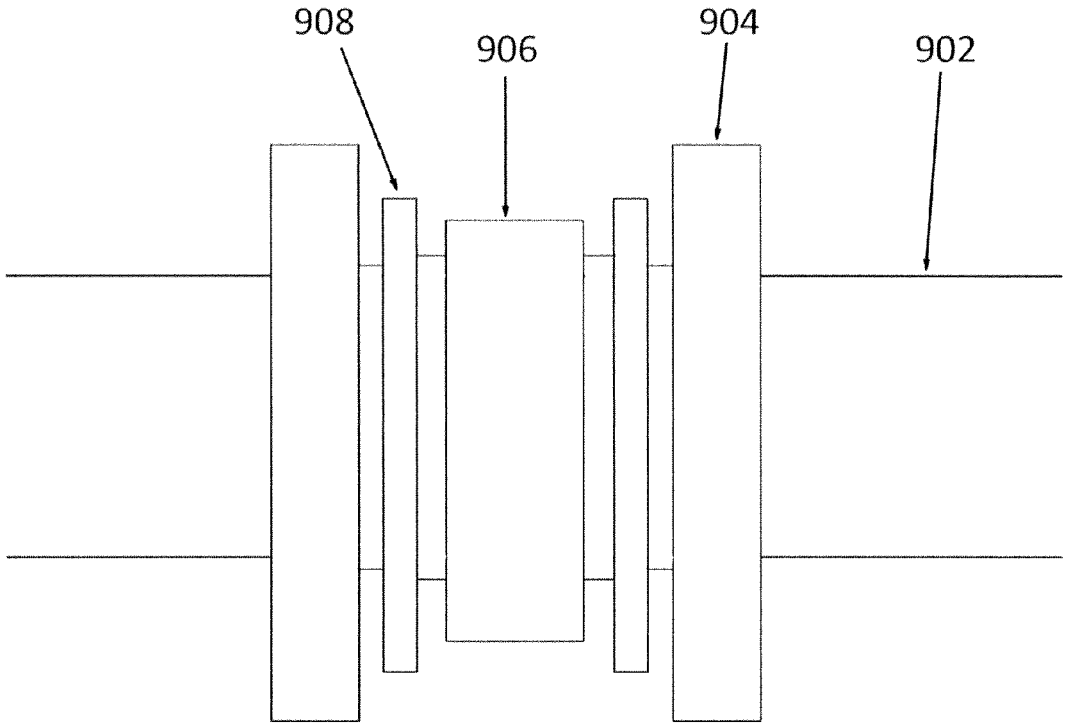
FIG. 9A illustrates a side view of another embodiment of a collar and band to accommodate changes in tubular diameter.
Figure 9B:
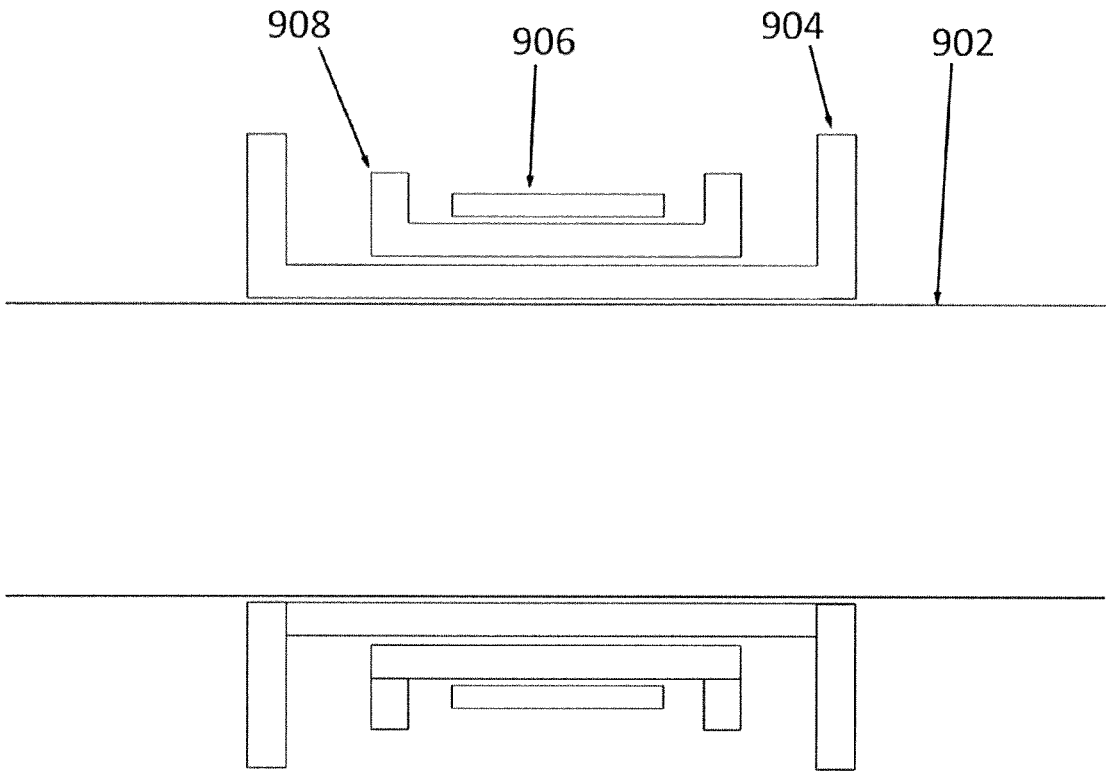
FIG. 9B illustrates a cross sectional view of the collar and band illustrated in FIG. 9A.

FIG. 9A illustrates a side view of another embodiment of a collar and band to accommodate changes in tubular diameter. FIG. 9B illustrates a cross-sectional view of the collar and band of FIG. 9A. Collar 904 is shown positioned around tubular 902 with band 906 wrapped around collar 904 to hold collar 904 tightly around tubular 902. Collar 904 and band 906 may be substantially the same as previously discussed. Liner 908 may further be provided between band 906 and collar 904. Liner 908 may be made of a resilient material that may expand or contract to accommodate shrinkage or any other diameter variation of tubular 902 and therefore help to keep collar 904 tightly positioned around tubular 902. For example, when a diameter of tubular 902 decreases, it is important that a diameter of collar 904 also decrease so that it remains tightly fastened around tubular 902. In embodiments where band 906 has a fixed length, a diameter of collar 904 is not decreased by band 906 resulting in collar 904 becoming loose around tubular 902. The decreased diameter of tubular 902 results in a gap between collar 904 and tubular 902 and/or collar 904 and band 906. This gap can be filled by the expansion of liner 908, which is compressed between band 906 and collar 904, which in turn, tightens collar 904 around tubular 902.

In some embodiments, liner 908 is U-shaped so that band 906 does not slide off of liner 908. Liner 908 may also serve as a guide during installation. For example, liner 908 may be pre-assembled with the band 906 or liner 908 may be attached to the collar 904 and then the band 906 placed on top of liner 908. In other embodiments, liner 908 is substantially flat. Liner 908 may be on top of collar 904 or under collar 904. Band 906 and liner 908 may be attached to each other by any suitable means, or may simply be placed on top of one another with either band 906 or liner 908 tensioned (or both may be tensioned).

Liner 908 may be of any thickness or width and may be wider than band 906 if it is U-shaped. However, liner 908 may be of any suitable cross section and thus does not need to necessarily be wider than band 906. Liner 908 may be of any suitable thickness depending upon the material and desired resilient properties or liner 908. Liner 906 may be made of any suitable resilient material, such as, for example, a foam, rubber, or thermoplastic.

Figure 10:
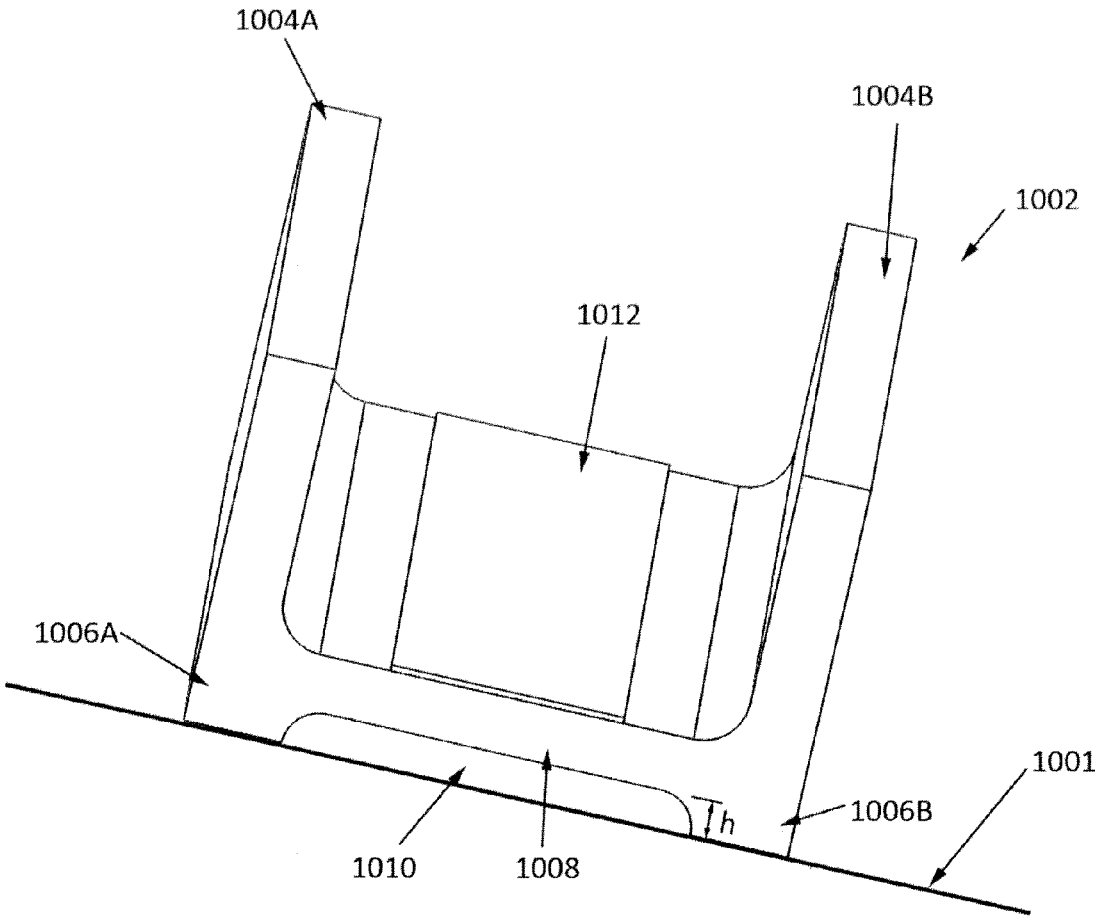
FIG. 10 illustrates a cross-sectional view of an embodiment of a collar that is shaped to accommodate tubular diameter changes.

FIG. 10 illustrates a cross-sectional view of a collar that is shaped to accommodate tubular diameter changes. In some embodiments, instead of, or in addition to, a resilient liner and/or resilient bands such as those previously discussed, collar 1002 may have a modifiable shape that accommodates changes in a diameter of an underlying tubular 1001. Representatively, collar 1002 may have flanges 1004A, 1004B extending from opposite sides of base portion 1008 to form a U-shaped collar 1002. Posts 1006A, 1006B may extend from ends of flanges 1004A, 1004B, respectively, adjacent base portion 1008. A bottom face of base portion 1008 and posts 1006A, 1006B define channel 1010 along a side of collar 1002 facing tubular 1001. When collar 1002 is installed on tubular 1001, posts 1006A, 1006B press against tubular 1001 and channel 1010 forms a gap between tubular 1001 and collar 1002. When band 1012 is tightened against collar 1002, posts 1006A, 1006B flex and bottom portion 1008 of collar 1002 is pressed toward tubular 1001. The flexibility of posts 1006A, 1006B result in collar 1002 having a built in spring like mechanism that allows collar 1002 to accommodate changes in the diameter of tubular 1001. As long as there is sufficient deflection of posts 1006A, 1006B (and therefore pressure on collar 1002 by band 1012), collar 1002 is sufficiently clamped around tubular 1001 and restricts adjacent structural members from causing it to slide along tubular 1001. For example, collar 1002 may be installed around tubular 1001 and tightened with band 1012 so that posts 1006A, 1006B flex drawing bottom portion 1008 of collar 1002 toward tubular 1001. If a diameter of tubular 1001 decreases after installation, posts 1006A, 1006B begin to straighten and continue to apply pressure against tubular 1001 so that collar 1002 remains tightly fastened around tubular 1001. Similarly, if a diameter of tubular 1001 increases, posts 1006A, 1006B may flex to an even greater degree to accommodate the increased diameter. In this aspect, a height (h) of posts 1006A, 1006B and/or channel 1010 may correspond to an overall diameter change of tubular 1001. For example, a height ranging from 0.20 inches to 2 inches.

Still referring to FIG. 10, flanges 1004A and 1004B, posts 1006A and 1006B, and channel 1010 may be of any suitable size, and their cross-sectional shape may be of any suitable shape including, but not limited to, rectangular, trapezoidal and square. In some embodiments, channel 1010 may have an optional additional groove to accommodate a band. In addition, channel 1010 may have an optional additional groove or notches to control its bending stiffness. Posts 1006A and 1006B may have optional additional appurtenances to keep them from sliding axially outwards. Collar 1002, including its associated components (e.g. flanges 1004A and 1004B, posts 1006A and 1006B, and channel 1010, may be made of any suitable material including, but not limited to, rubber, plastic, metal, synthetics, composites, or fabric. Each component of collar 1002 may be of the same material or different members may be constructed of different materials.

Although the spring like post assembly is described in connection with a collar, it is further contemplated that a similar post assembly may be used in connection with a band positioned around the collar. For example, a surface of the band facing the collar and tubular may include posts that extend in the direction of the collar and contact the collar. When a diameter of the underlying tubular changes, which in turn changes a diameter of the collar, the posts extending from the band may flex to accommodate the diameter changes in a manner similar to that which was previously discussed.

Figure 11:
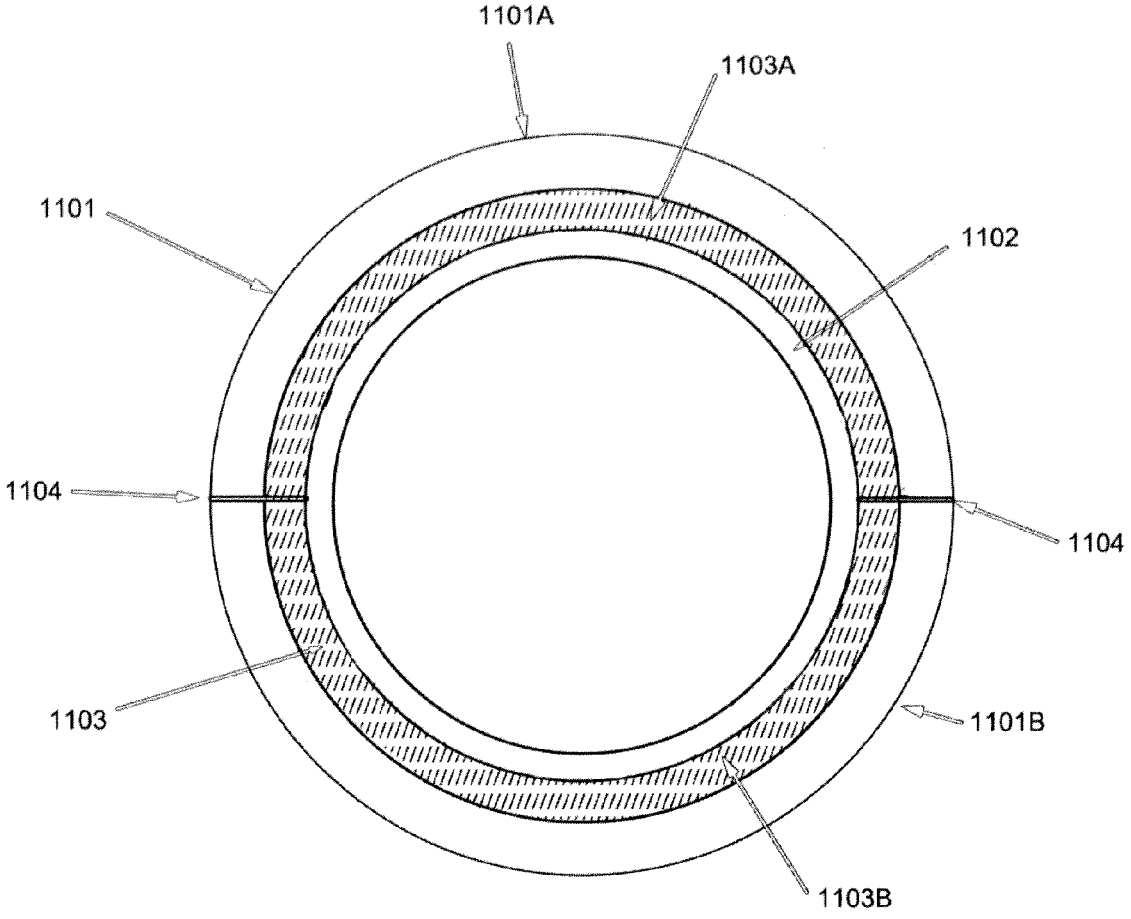
FIG. 11 illustrates a cross-sectional view of an embodiment of a collar having a resilient member to accommodate changes in tubular diameter.

FIG. 11 illustrates a cross-sectional view of an embodiment of a collar having a resilient member to accommodate changes in tubular diameter. According to this embodiment, resilient member 1103 is positioned between collar 1101 and tubular 1102. As collar 1101 is tightened, resilient member 1103 is compressed around tubular 1102. Collar 1101 and resilient member 1103 may be divided into two or more circumferential sections 1101A, 1101B having openings 1104 in between so that collar 1101 and resilient member 1103 may be easily placed around tubular 1102. Resilient member 1103 may be, for example, a spring or any other similarly resilient structure or material, for example rubber, specifically urethane or similar rubber, a soft plastic, or other material that can compress and produce a spring load on collar 1101.

By tightening the two halves of collar 1101 against resilient member 1103 with, for example a band such as those previously discussed, collar 1101 puts pressure on resilient member 1103 which, in turn, puts pressure on tubular 1102. This pressure allows for collar 1101 to withstand forces against it along the axis of tubular 1102, so that objects pushing on collar 1101 do not cause it to slide along tubular 1102. When tubular 1102 changes diameter, resilient member 1103 also changes diameter to accommodate the change in diameter of tubular 1102. By maintaining resilient member 1103 in compression, the combination of collar 1101 and resilient member 1103 allows for changes in the diameter of tubular 1102, while still maintaining pressure on tubular 1102.

Sections 1101A, 1101B of collar 1101 are typically either held together with bands around them or with fastening members (e.g. bolts) between them. When bolted together, section 1101A of collar 1101 may be hinged to section 1101B on one side, with bolts on the other side. Alternatively, bolting may be used on both sides of collar 1101 where sections 1101A, 1101B are joined together. Sections 1101A, 1101B of collar 1101 may each encircle 180 degrees of tubular 1102 circumference, or one or more halves may encircle more or less than 180 degrees of the tubular 1102 circumference. Sections 1101A, 1101B of collar 1101 may together encircle 360 degrees of the tubular 1102 circumference, or sections 1101A, 1101B may together encircle less than 360 degrees of tubular 1102 circumference. Collar 1101 may be made of more than or less than two segments. Gaps 1104 may be formed between the collar sections 1101A, 1101B and may be very small or comprise a significant portion of the circumference of tubular 1102.

In one embodiment, resilient member 1103 may have a similar profile to that of sections 1101A, 1101B so that it conforms to the surface of sections 1101A, 1101B when placed around tubular 1102. In this aspect, resilient member 1103 may be formed by sections 1103A, 1103B having lengths similar to that of sections 1101A, 1101B. Resilient member 1103 may be attached to collar 1101 in any manner suitable to fixedly hold resilient member 1103 to collar 1101, for example, molding, welding, bolting, chemical bonding, adhesive or the like.

Figure 12:
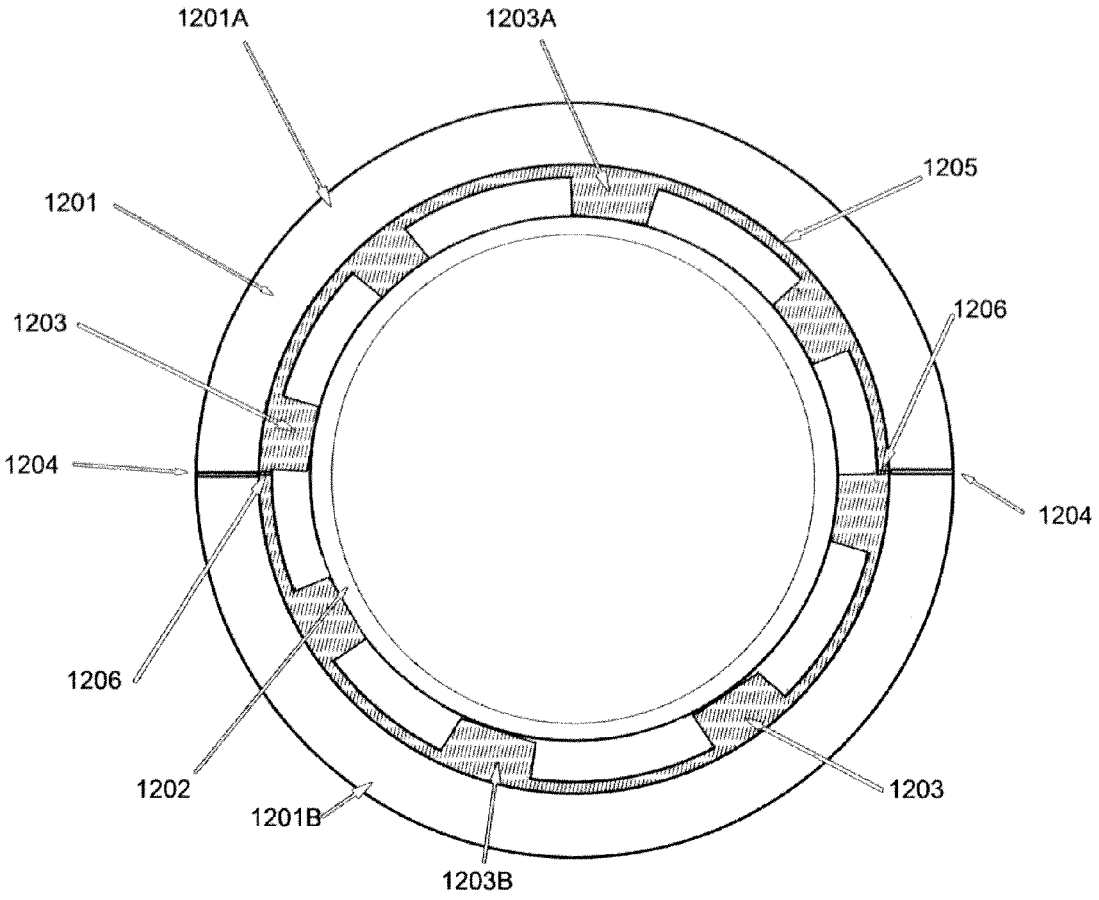
FIG. 12 illustrates a top view of another embodiment of a collar having a resilient member to accommodate changes in tubular diameter.

FIG. 12 illustrates a top view of another embodiment of a collar having a resilient member to accommodate changes in tubular diameter. In this embodiment, collar 1201 and resilient member 1203 are substantially similar to those discussed in reference to FIG. 11 except that resilient member 1203 includes a backing piece 1205 that is attached to collar 1201 and short segments that are adjacent to tubular 1202. Attachment of collar 1201 to backing piece 1205 of resilient member 1203 may be made by chemical bonding, fastening, or clamping. In addition, resilient member 1203 includes two or more sections or segments 1203A, 1203B that attach to sections 1201A, 1201B, respectively, of collar 1201. Sections 1201A, 1201B and sections 1203A, 1203B mate at opening 1206. Sections 1201A, 1201B of collar 1201 and opening 1204 between sections 1201A, 1201B may be substantially the same as those previously discussed in reference to FIG. 11.

Resilient member 1203 can be made of rubber, specifically urethane or similar rubber, a soft plastic, or other material that can compress and produce a spring load on collar 1201. Resilient member 1203 may also be made of more than one material, for example with the backing piece 1205 that attaches to collar 1201 made of one material and the protrusions that contact tubular 1202 made of a different material.

Figure 13:
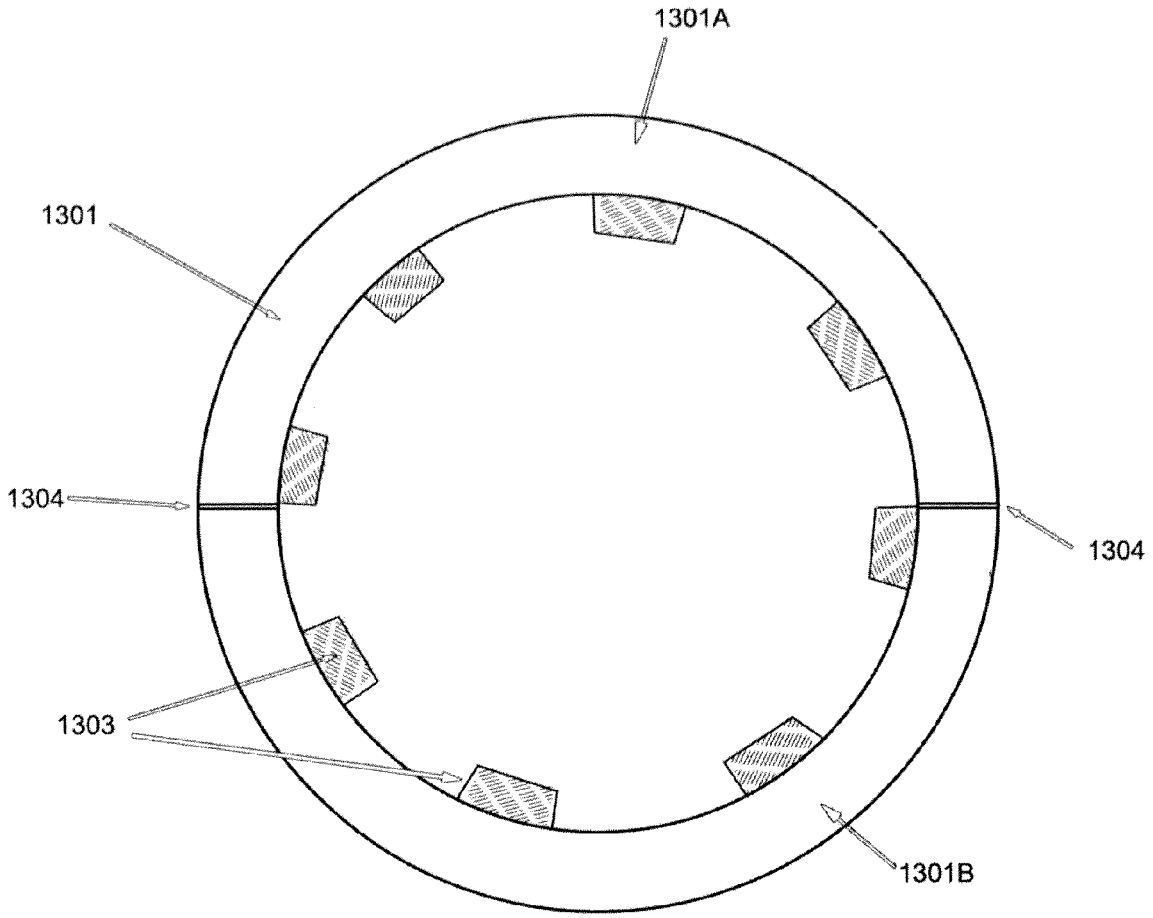
FIG. 13 illustrates a top view of another embodiment of a collar having a resilient member to accommodate changes in tubular diameter.

FIG. 13 illustrates a top view of another embodiment of a collar having a resilient member to accommodate changes in tubular diameter. In this embodiment, collar 1301 and resilient member 1303 are substantially similar to those discussed in reference to FIG. 12 except that resilient member 1303 does not include a backing piece. Instead, segments of resilient member 1303 are attached directly to collar 1301 by molding, welding, bolting, chemical bonding, adhesive or the like. Collar 1301 may be divided into sections 1301A, 1301B separated at their ends by openings 1304.

Figure 14:
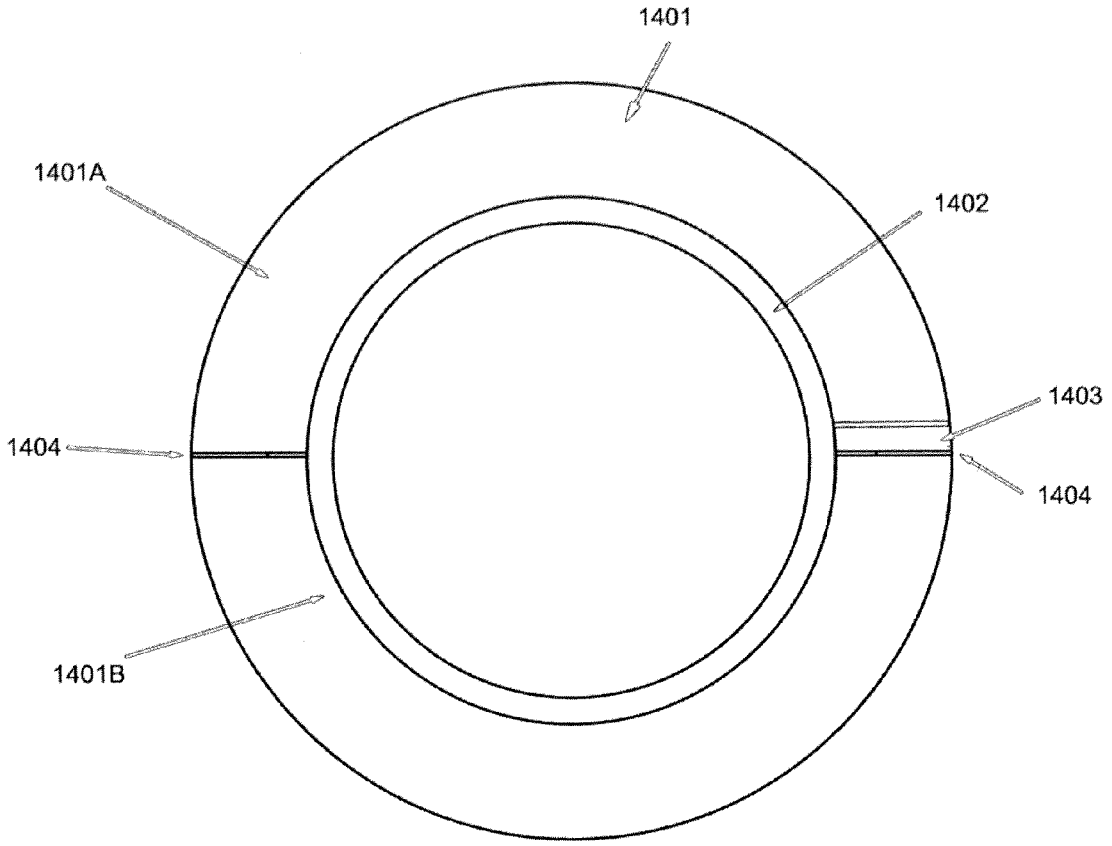
FIG. 14 illustrates a top view of another embodiment of a collar having a resilient member to accommodate changes in tubular diameter.

FIG. 14 illustrates a top view of another embodiment of a collar having a resilient member to accommodate changes in tubular diameter. According to this embodiment, resilient member 1403 is incorporated into an opening 1404 formed between sections 1401A, 1401B of collar 1401. Collar sections 1401A, 1401B encircle underlying tubular 1402. Collar sections 1401A and 1401B may be connected to each other at one end by hinges or fasteners positioned at abutting ends, banding that encircles the collar, or other suitable means.

When collar sections 1401A and 1401B are tightened together, resilient member 1403 is compressed and pressure is imposed upon tubular 1402. This pressure allows for collar sections 1401A and 1404B as well as resilient member 1403, to withstand forces against it along the axis of tubular 1402. When tubular 1402 changes diameter, collar 1401 also changes diameter through changes in the size of resilient member 1403. By maintaining resilient member 1403 in compression or extension, collar 1401 can withstand changes in the diameter of tubular 1402 while still maintaining pressure on tubular 1402. Attachment of resilient member 1403 to collar section 1401A (or section 1401B) may be made by fastening such as bolting, mechanical interference (with the spring at least partially encased in a housing that may, or may not, be separate from collar section 1401A), chemical bonding, or other suitable means.

Resilient member 1403 may be a spring or other resilient structure made of, for example, rubber, specifically urethane or similar rubber, a soft plastic or other material that can compress or extend and produce a spring load on collar section 1401A or 1401B.

Figure 15:
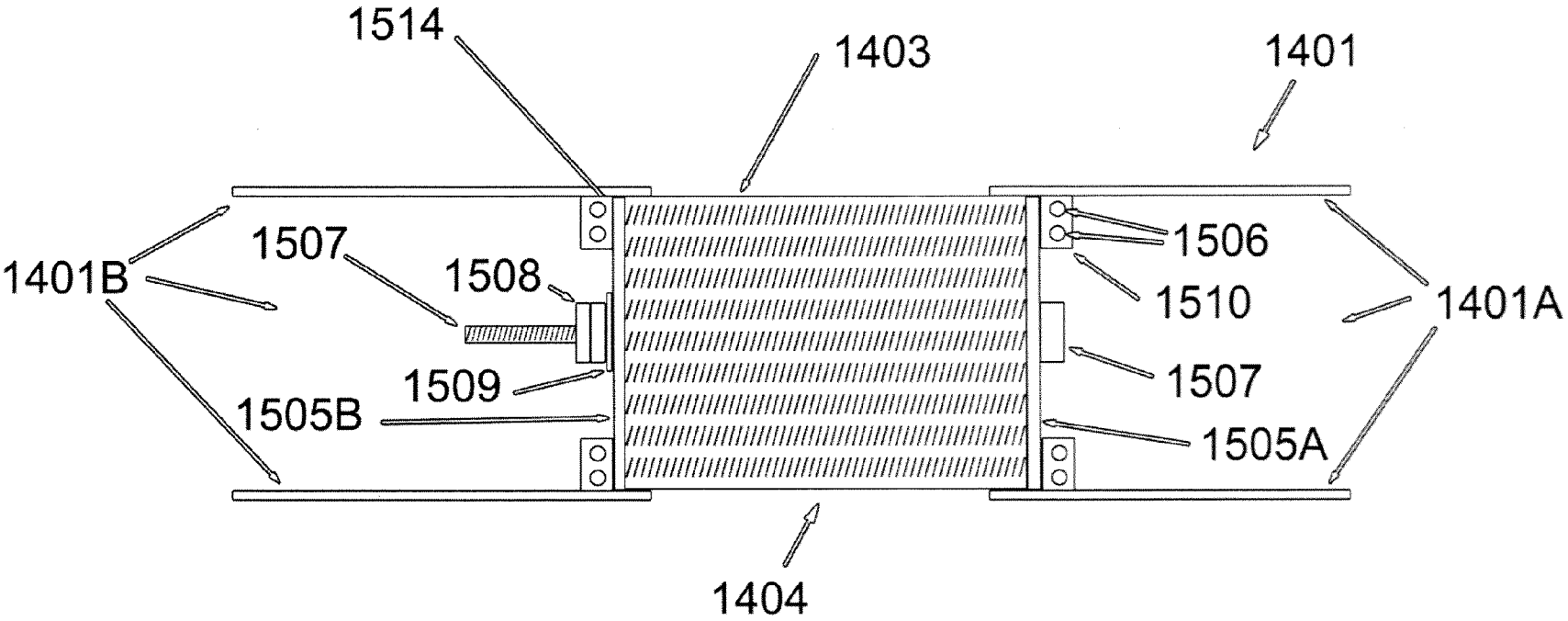
FIG. 15 illustrates a side view of the collar and resilient member illustrated in FIG. 14.

FIG. 15 illustrates a side view of the collar and resilient member illustrated in FIG. 14. From this view, it can be seen that resilient member 1403 attaches to adjacent ends of collar sections 1401A, 1401B across gap 1404. In one embodiment, collar section 1401A is connected to bracket 1505A. Bolt 1507 goes through bracket 1505A, bracket 1505B, resilient member 1403 and end plate 1514. Nuts 1508 and washer 1509 are partially threaded onto bolt 1507. Collar section 1401B is connected to bracket 1505B so that they act as a single member. Similarly, collar section 1401A is connected to bracket 1505A so that they act as a single member.

When bolt 1507 is tightened against nuts 1508, resilient member 1403 is compressed. As bolt 1507 is tightened, end plate 1514, which is free to slide along the channel formed by collar end 1401B, moves toward the bolt head, or towards collar section 1401A. This compresses resilient member 1403 between end plate 1514 and bracket 1505B. While collar section 1401A and collar section 1401B are shown in contact with each other, it is possible to leave a gap between them. A second resilient member can be placed on bolt 1507 in this gap. This second resilient member can also serve as the primary resilient member with the resilient member 1403 shown in FIG. 15 omitted.

Figure 16:
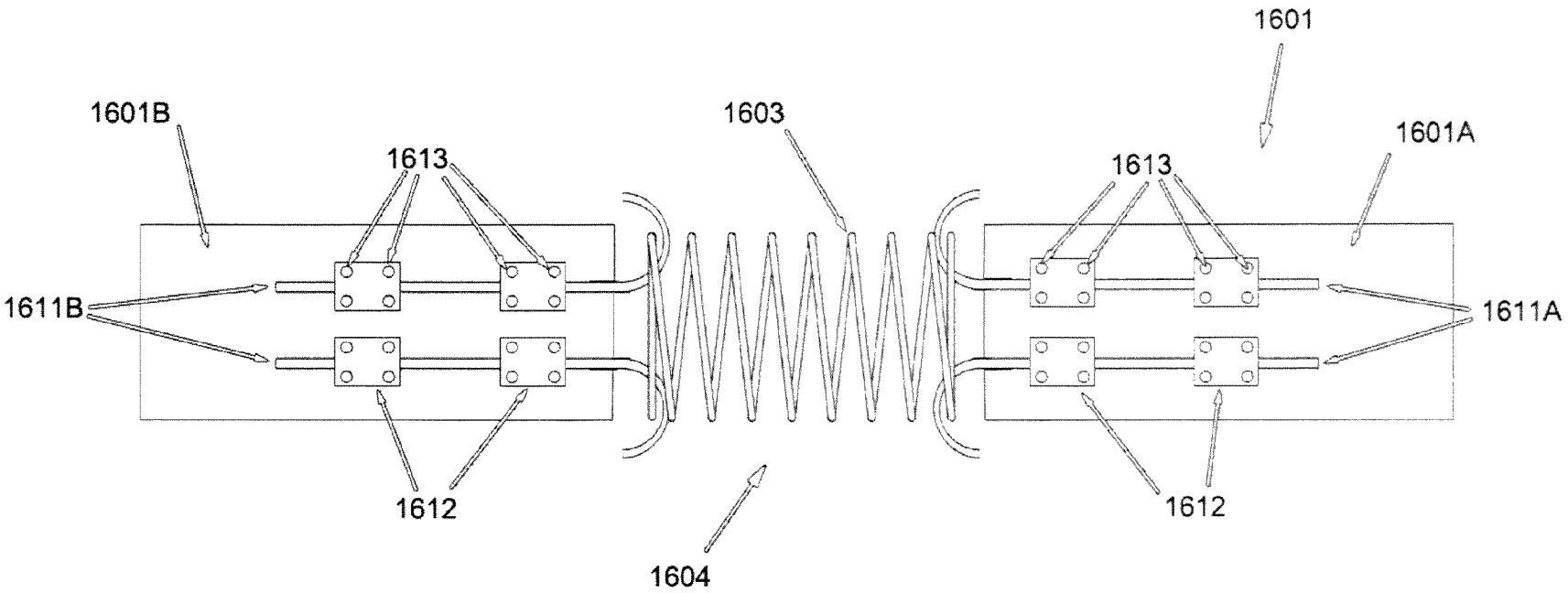
FIG. 16 illustrates a side view of another embodiment of a collar having a resilient member to accommodate changes in tubular diameter.

In embodiments where resilient member 1403 is a spring, the spring may be from about ½ to 10 inches in length, depending upon the required spring properties and the tubular diameter. Spring 1403 may be round and ½ to 6 inches in diameter, depending upon the required spring properties and the tubular diameter. Spring 1403 may be made of any suitable cross section. Collar sections 1401*a* and 1401*b* may be made of any suitable cross section, though they are shown as U-shaped channel for most of the figures herein (in FIG. 15, the channel is viewed from the open side). Spring 1403 may be a solid material or may be a coiled spring or any other shaped that meets the required compression spring properties. Resilient member 1403 can be made of rubber, specifically urethane or similar rubber, a soft plastic or other material that can compress or extend and produce a spring load on collar section 1401A FIG. 16 illustrates a side view of another embodiment of a collar having a resilient member to accommodate changes in tubular diameter. In this embodiment, collar 1601 includes collar sections 1601A, 1601B attached at adjacent ends by resilient member 1603 extending across gap 1604. In this embodiment, resilient member 1603 is an extension spring. Brackets 1612 are attached by fasteners 1613 to collar sections 1601A and 1601B and contain hooks 1611A and 1611B. Tension in the collar sections 1601A, 1601B extends resilient member 1603.

Hooks 1611A and 1611B may be attached via brackets 1612 but may also be welded, chemically bonded, or fastened by other suitable means to withstand the tension produced by collar sections 1601A and 1601B. Extension of resilient member 1603, produced by tension in collar sections 1601A and 1601B, allows for the system to accommodate changes in diameter of the tubular to which the collar is applied. The system may be pre-tensioned by extending the spring with a tool and catching it onto the hooks, by tightening the collar at another location along its circumference via banding, bolting or other suitable means, or by displacing the hooks 1611A and 1611B into the pre-tensioned position and then attaching them to collar sections 1601A and 1601B.

Resilient member 1603 can range from about ½ to 24 inches in length, for example, from 2 to 16 inches in length, depending upon the tubular diameter and the required spring properties. Resilient member 1603 is typically round and ½ to 6 inches in diameter, depending upon the required spring properties and the tubular diameter. Resilient member 1603 may be made of any suitable cross section and its coils may be made of any suitable cross section to achieve the desired spring properties.

Figure 17:
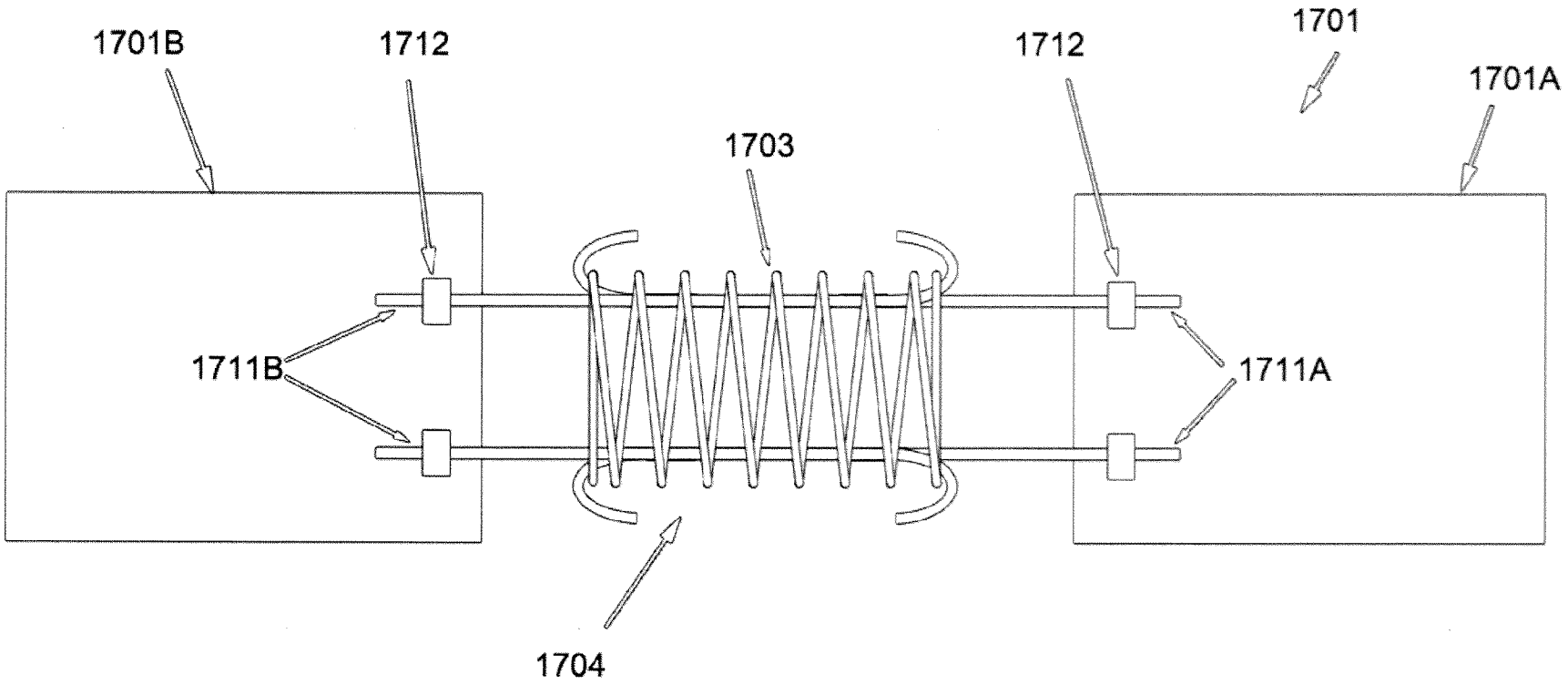
FIG. 17 illustrates a side view of another embodiment of a collar having a resilient member to accommodate changes in tubular diameter.

FIG. 17 illustrates a side view of another embodiment of a collar having a resilient member to accommodate changes in tubular diameter. In this embodiment, collar 1701 includes collar sections 1701A, 1701B attached at adjacent ends by resilient member 1703 extending across gap 1704. In this embodiment, resilient member 1703 is a compression spring. Brackets 1712 are attached to collar sections 1701A and 1701B and contain hooks 1711A and 1711B. Hooks 1711A extend through resilient member 1703 from right to the left end of resilient member 1703. Hooks 1711B extend through resilient member 1703 from left to the right end of resilient member 1703. Tension on hooks 1711A and 1711B produce compression of resilient member 1703. Resilient member 1703 may have substantially similar dimensions and be made of a similar material to previously discussed resilient members.

Figure 18:
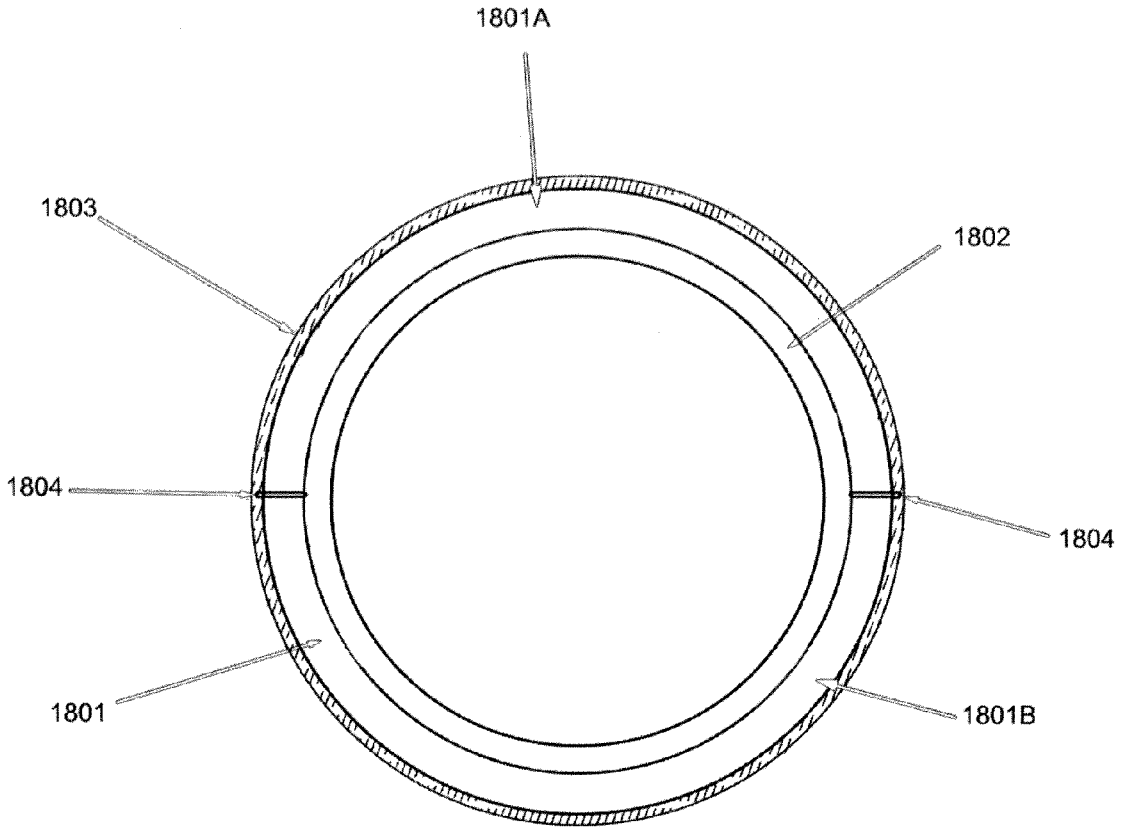
FIG. 18 illustrates a top view of another embodiment of a collar having a resilient member to accommodate changes in tubular diameter.

FIG. 18 illustrates a top view of another embodiment of a collar having a resilient member to accommodate changes in tubular diameter. In this embodiment, collar 1801 encircles tubular 1802, and resilient member 1803 encircles collar 1801. This configuration may be used with a band (not shown) around the outside of resilient member 1803 that is tightened to produce radial pressure of collar 1801 onto tubular 1802. Collar 1801 may be formed as sections 1801A, 1801B having openings 1804 in between. In addition, resilient member 1803 may be made in sections.

When a structural member, such as a band, is tightened around resilient member 1803, resilient member 1803 is compressed and a radial force is imparted onto collar 1801 which, in turn, produces a radial force on tubular 1802. This radial force, or pressure, allows collar 1801 to withstand forces from adjacent structures to resist sliding along the tubular. If the diameter of tubular 1802 is reduced due to hydrostatic pressure or any other means, resilient member 1801 expands some but, if properly designed, will still be under compression and allow for radial force to be imparted by collar 1801 onto tubular 1802.

A radial height of collar 1801 can range from ½ to 12 inches, for example, from 2 to 6 inches in height. Resilient member 1803 can range in height from ⅛ to 6 inches, for example from ¼ to 3 inches in height. Resilient member 1803 may be a spring or other similarly resilient device and can be made of rubber, specifically urethane or similar rubber, a soft plastic or other material that can compress and produce a spring load on collar 1801.

Figure 19:
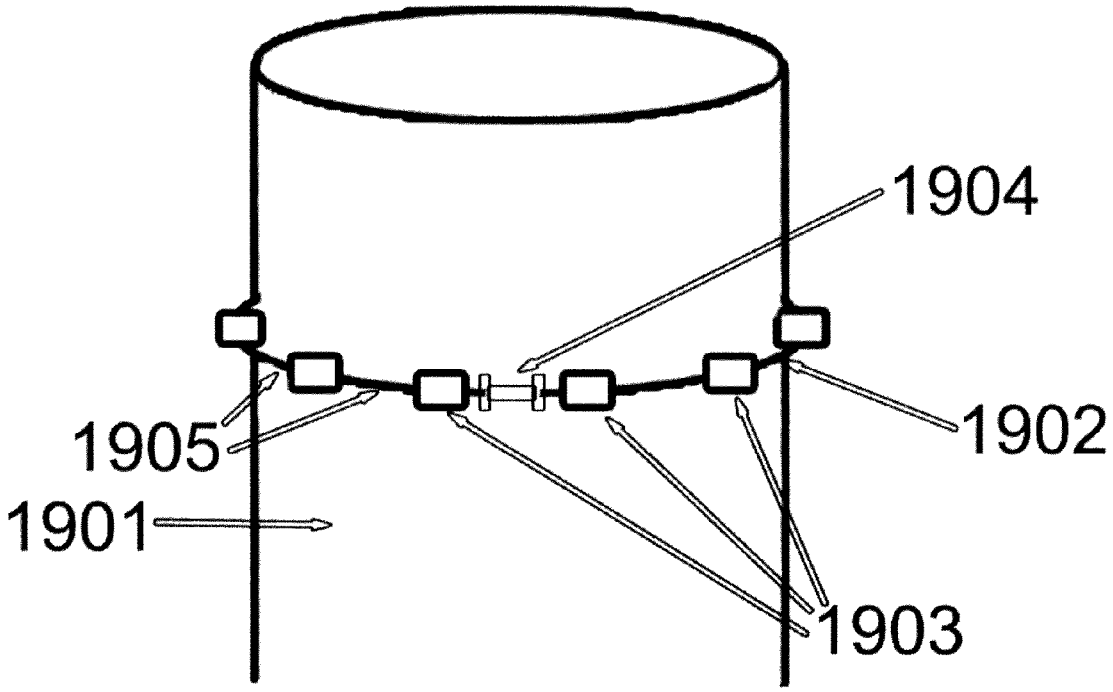
FIG. 19 illustrates a perspective view of another embodiment of a collar having a resilient member to accommodate changes in tubular diameter.

FIG. 19 illustrates a perspective view of another embodiment of a collar having a resilient member to accommodate changes in tubular diameter. In this embodiment, collar 1902 includes support member 1902 dimensioned to encircle tubular 1901 and collar segments 1903 attached to support member 1902. Support member 1902 has a substantially narrow profile therefore collar segments 1903 are attached to support member 1902 to support an adjacent VIV suppression device. Representatively, support member 1902 may be, for example, a rope, band, strap, or any other similarly suitable structure for encircling a tubular. Connecting member 1904 for tightening collar 1902 around tubular 1901 allows for sufficient pressure to be imposed by collar 1902 onto tubular 1901 to withstand forces imposed by the associated VIV suppression device so that collar 1902 does not slide along tubular 1901. In some embodiments, a resilient member may be coupled to connecting member 1904 and/or support member 1902 to accommodate changes in tubular diameter.

It is noted that by increasing the size of support member 1902 using segments 1903, the associated VIV suppression device is less likely to slide over collar 1902 thereby restricting the ability of the VIV suppression device to move vertically past collar 1902 and/or to weathervane around tubular 1901. Segments 1903 are therefore designed to add size to collar 1902 without having to fully cover support member 1902. These segments 1903 are easier and faster to fabricate than sections that cover a significant portion of the diameter of tubular 1901 and therefore must be formed to the correct diameter of tubular 1901. Using segments 1903 also allows collar 1902 to be adjustable for different diameter tubulars 1901 by adjusting the length of support member 1902 to accommodate the desired tubular.

Segments 1903 may be a variety of shapes but will be typically symmetric or substantially symmetric about support member 1905 circumferential axis so as to minimize their tendency to spin about support member 1905 circumferential axis. Another desired feature of segments 1903 is to maximize the amount of surface area in contact with tubular 1901 to maximize their frictional resistance. Thus, it is desired that segments 1903 be block shaped, trapezoidal in shape, or L shaped. Segments 1903 can be made of any suitable material for withstanding seawater though it is also desired that they be somewhat light in seawater or close to neutrally buoyant. While segments 1903 can be small, it is important that the space between adjacent segments 1903 be smaller than the width of the tail so that the tail cannot fall to the area between adjacent segments 1903. Support member 1905 will typically opened and placed around tubular 1901 with connecting member 1904 that includes an inline resilient member to allow for accommodation of various diameter sizes and for shrinkage of the outside diameter of tubular 1901 due to hydrostatic pressure. The support member 1905 with segments 1903 collar design may be used in addition to, or in place of, the previously discussed collar designs. In particular, any of the previously discussed collar designs may consist of multiple collar segments attached to a support member and any of the previously discussed resilient members to modify a length of the collar in response to a tubular diameter change.

Figure 20B:
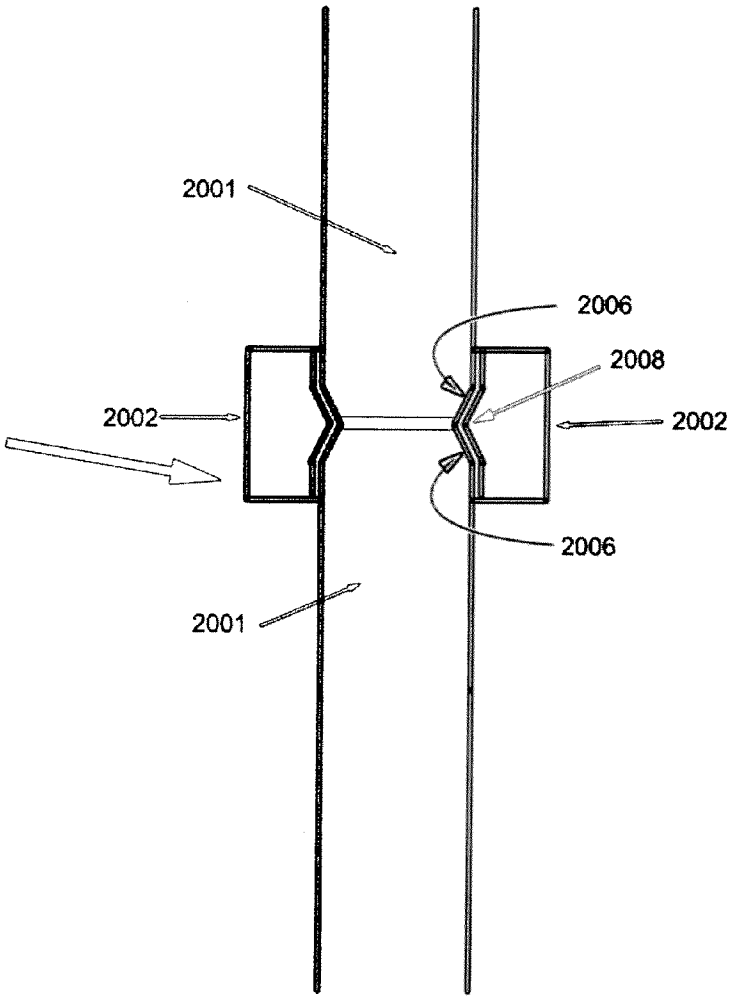
FIG. 20B illustrates a cross-sectional view of the collar of FIG. 20A along line D-D'.
Figure 20A:
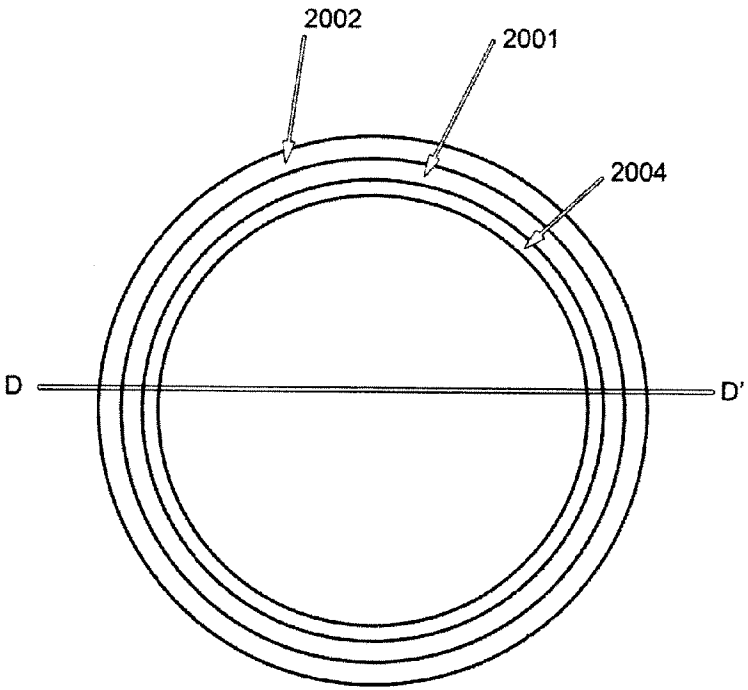
FIG. 20A illustrates a top view of another embodiment of a collar.

FIG. 20A illustrates a top view of another embodiment of a collar. FIG. 20B illustrates a cross-sectional view of the collar of FIG. 20A along line D-D'. Tubular 2004 is shown encircled by buoyancy device 2001. Buoyancy devices 2001 may be, for example, a cylindrical foam structure which serves to insulate and/or provide buoyancy to tubular 2004. Buoyancy devices 2001 may have tapered ends 2006 which are complimentary to protrusion 2008 extending from an inner surface of collar 2002. This allows collar 2002 to accommodate shrinkage of a diameter of buoyancy device 2001 due to hydrostatic pressure, and also allows collar 2002 to accommodate multiple VIV suppression devices with a single collar 2002. Tapered ends 2006 of buoyancy device 2001 are utilized to provide interference and collar 2002 is designed to take advantage of those tapers to restrain collar 2002 from sliding along the buoyancy device 2001.

In addition to tapered ends 2006, buoyancy device 2001 may have grooves or indentations around the circumference that can be used to support collar 2002. In either case, the inner profile of collar 2002 is shaped to protrude into the tapered ends, grooves, or indentations of buoyancy device 2001 to provide interference for collar 2002 and allow it to support VIV suppression devices without additional pressure or tension on collar 2002 on the surface of buoyancy device 2001. Buoyancy device 2001 may also have flanges or other protrusions on its surface. In this case, collar 2002 may utilize these protrusions to provide interference for collar 2002 and allow it to support tails and straps without additional pressure or tension on collar 2002 on the surface of buoyancy device 2001. In most cases, buoyancy device 2001 will only have tapered ends that can be utilized by collar 2002 to minimize additional mechanical pressure or tension on collar 2002.

Alternatively, in some embodiments, a tensioning mechanism such as a band and/or resilient member as previously discussed may be used along with collar 2001 to reinforce the attachment of collar 2001 around buoyancy device 2001 and to accommodate changes in a diameter of buoyancy device 2001. In particular, any of the previously discussed collar designs may be placed over a buoyancy device positioned around the tubular and include protrusions along an inner surface that fit within a groove formed around the buoyancy device.

It is contemplated that although in the foregoing description the bands including a resilient member or separate resilient members are used to tighten a collar against an underlying tubular, it is contemplated that the band and resilient member assemblies previously discussed may also be used in connection with the suppression devices and the collars may be optional. For example, in an embodiment where the suppression device is a helical strake, a band having a resilient member may be wrapped around the helical strake to hold the strake around the tubular such that a collar is no longer needed. In addition, or alternatively, a resilient member may be attached between helical strake sleeve sections or between the sleeve and the underlying tubular such that the helical strake sleeve can accommodate a change in the underlying tubular diameter in a manner similar to that previously discussed with respect to the various collar designs.

It should also be appreciated that reference throughout this specification to "one embodiment", "an embodiment", or "one or more embodiments", for example, means that a particular feature may be included in the practice of the invention. Similarly, it should be appreciated that in the description various features are sometimes grouped together in a single embodiment, Figure, or description thereof for the purpose of streamlining the disclosure and aiding in the understanding of various inventive aspects. This method of disclosure, however, is not to be interpreted as reflecting an intention that the invention requires more features than are expressly recited in each claim. Rather, as the following claims reflect, inventive aspects may lie in less than all features of a single disclosed embodiment. Thus, the claims following the Detailed Description are hereby expressly incorporated into this Detailed Description, with each claim standing on its own as a separate embodiment of the invention.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

The invention claimed is:

1. An apparatus comprising:

a collar member dimensioned to encircle an underlying tubular, the collar member having a base portion and flanges extending perpendicularly from the base portion, the flanges operable to (1) support a vortex induced vibration (VIV) suppression device entirely above or entirely below the collar member and (2) axially position the VIV suppression device along an underlying tubular such that the VIV suppression device remains axially aligned along an underlying tubular and is free to weathervane around a tubular while the collar member remains substantially stationary, the collar member having a height less than 25 percent a height of the VIV suppression device and a modifiable diameter to accommodate a change in a diameter of the underlying tubular;

a resilient member coupled to the collar member, the resilient member having a plurality of discrete sections protruding from an outer surface of the collar member to accommodate a change in the diameter of the underlying tubular, wherein the outer surface faces away from an underlying tubular around which the collar member is positioned, and wherein the plurality of discrete sections are annularly spaced a distance from one another around the underlying tubular such that spaces are formed between each of the plurality of sections and portions of the collar member within the spaces are exposed; and a band positioned around, and having an inner surface in direct contact with, each of the discrete sections of the resilient member.

2. The apparatus of claim 1 wherein the resilient member comprises a U-shaped profile.

3. The apparatus of claim 1 wherein the resilient member comprises a foam material or a rubber material.

4. A method comprising:

modifying a diameter of a collar member positioned around a tubular in response to a diameter change of the tubular such that the collar member remains substantially stationary at an axial position along the tubular while a vortex-inducted vibration suppression device supported by the collar member is free to rotate about the tubular, the collar member having a base member and perpendicularly extending flanges dimensioned to contact and support a bottom side or a top side of the vortex-induced vibration suppression device and having a height less than 25 percent of a height of the vortex-induced vibration suppression device, wherein modifying the diameter comprises changing a size of a resilient member coupled to the collar in response to the change in diameter of the tubular, wherein the resilient member comprises a plurality of sections annularly spaced around an outer surface of the collar member, wherein the outer surface faces away from the tubular and wherein the collar member comprises a first section and a second section hinged together to allow for opening and closing of the collar member around the tubular.

5. The method of claim 4 wherein a size of the resilient member increases in response to a decrease in the diameter of the tubular.

6. The method of claim 4 wherein a size of the resilient member decreases in response to an increase in the diameter of the tubular.

* * * * *